US009310724B2

(12) United States Patent
Fukuda et al.

(10) Patent No.: US 9,310,724 B2
(45) Date of Patent: Apr. 12, 2016

(54) IMAGE HEATING UNIT, RECORDING MEDIUM CONVEYING UNIT AND IMAGE FORMING APPARATUS

(71) Applicant: CANON KABUSHIKI KAISHA, Tokyo (JP)

(72) Inventors: Takeshi Fukuda, Nagareyama (JP); Keisuke Yoshida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/469,857

(22) Filed: Aug. 27, 2014

(65) Prior Publication Data

US 2015/0063868 A1 Mar. 5, 2015

(30) Foreign Application Priority Data

Aug. 30, 2013 (JP) ..... 2013-179806
Sep. 24, 2013 (JP) ..... 2013-196966

(51) Int. Cl.
*G03G 15/20* (2006.01)

(52) U.S. Cl.
CPC ..... *G03G 15/2028* (2013.01); *G03G 15/2017* (2013.01)

(58) Field of Classification Search
CPC ..... G03G 15/2028; G03G 15/2071; G03G 15/2085; G03G 15/2035; G03G 21/1638; G03G 15/2017
See application file for complete search history.

(56) References Cited

U.S. PATENT DOCUMENTS 3,778,222 A * 12/1973 Suzuki ..... 432/35
5,239,349 A * 8/1993 Hoover et al. ..... 399/122
5,253,013 A * 10/1993 Takano et al. ..... 399/130
5,291,256 A * 3/1994 Kitajima et al. ..... 399/122
5,305,065 A * 4/1994 Hoover et al. ..... 399/114
5,528,345 A * 6/1996 Hasegawa ..... 399/122
5,732,309 A * 3/1998 Okuno et al. ..... 399/68
5,742,878 A * 4/1998 Kuroda ..... 399/122
6,950,618 B2 9/2005 Shimizu et al.
7,792,453 B2 * 9/2010 Baek et al. ..... 399/69
8,554,097 B2 10/2013 Hara et al.

(Continued)

FOREIGN PATENT DOCUMENTS

JP 2003140480 A * 5/2003 ..... G03G 15/20
JP 2004-157511 A 6/2004
JP 2006047593 A * 2/2006

OTHER PUBLICATIONS

Machine translation of JP 2003140480 A.*

(Continued)

*Primary Examiner* — David Bolduc
(74) *Attorney, Agent, or Firm* — Fitzpatrick, Cella, Harper & Scinto

(57) ABSTRACT

An image heating unit is detachably mountable to an image forming apparatus. The image heating unit includes: first and second rotatable members configured to feed a recording material in an image heating process; a casing enclosing the first and second rotatable member and provided with an opening configured to permit passage of the recording material; a movable member movable relative to the opening between a first position taken when the image heating process is carried out and a second position in which a jam clearance operation is operable through the opening and in which a test finger is prevented from entering through the opening into the casing; and a locking mechanism configured to lock the movable member at the second position.

11 Claims, 17 Drawing Sheets

(56) References Cited

U.S. PATENT DOCUMENTS

| | | | | |
|---|---|---|---|---|
| 8,620,182 | B2 * | 12/2013 | Suzuki | 399/122 |
| 8,666,285 | B2 * | 3/2014 | Mizuno et al. | 399/122 |
| 8,781,364 | B2 | 7/2014 | Fukuda et al. | |
| 8,958,716 | B2 * | 2/2015 | Saito | 399/92 |
| 2002/0186986 | A1 * | 12/2002 | Makihira | 399/92 |
| 2004/0052548 | A1 | 3/2004 | Shimizu et al. | |
| 2008/0226343 | A1 * | 9/2008 | Jeon et al. | 399/122 |
| 2011/0206424 | A1 * | 8/2011 | Tagami | 399/322 |
| 2013/0142552 | A1 | 6/2013 | Yoshida | |
| 2013/0188991 | A1 * | 7/2013 | Kawata et al. | 399/122 |
| 2014/0161479 | A1 | 6/2014 | Yoshida et al. | |
| 2014/0233992 | A1 * | 8/2014 | Koyama et al. | 399/322 |
| 2014/0314438 | A1 * | 10/2014 | Maeda et al. | 399/92 |
| 2014/0348542 | A1 | 11/2014 | Yoshida | |

OTHER PUBLICATIONS

U.S. Appl. No. 14/480,966, filed Sep. 9, 2014, to Takeshi Fukuda.

* cited by examiner (a)

(b)

(a)

(b)

IMAGE HEATING UNIT, RECORDING MEDIUM CONVEYING UNIT AND IMAGE FORMING APPARATUS

FIELD OF THE INVENTION AND RELATED ART

The present invention relates to a recording medium conveying unit, an image heating unit, and an image forming apparatus equipped with the preceding units.

Recently, it has come to be thought that the downtime of an image forming apparatus has to be reduced (length of time the image forming apparatus cannot be operated because of a recording medium jam). In other words, it has come to be thought that making it easier to remove jammed recording medium leads to a downtime reduction.

Thus, Japanese Laid-open Patent Application 2004-157511 discloses an image forming apparatus which employs a fixation unit which is removable from the image forming apparatus. More concretely, the image forming apparatus is structured so that a casing in which a heating belt unit and a pressure roller are integrally held is removably installable. By structuring an image forming apparatus so that a fixing means, which is one of the locations in the image forming apparatus, in which recording medium jams occurs, can be moved out of the image forming apparatus as disclosed in Japanese Laid-open Patent application 2004-157511, the cause of the recording medium jam can be easily found and eliminated.

By the way, a fixation unit such as the one described above is provided with an opening, which is a part of a recording medium conveyance passage through which recording medium is conveyed during image formation. Thus, it is possible that fingers of an operator of the image forming apparatus will accidentally enter the fixation unit through this opening, and damage internal components, such as the fixation roller, of the fixation unit. Therefore, it is desired that when the fixation unit is out of the main assembly of an image forming apparatus, this opening remains closed.

The fixation unit disclosed in Japanese Laid-open Patent Application 2004-157511 is structured so that as an operator attempts to grasp the fixation unit, the opening is automatically closed. More concretely, the fixation unit is provided with a shutter which is pivotally attached to one of the edges of the opening, and a spring which keeps the shutter pressed in the direction to move the shutter away from the opening.

With the provision of this structural arrangement, when the fixation unit is in the image forming apparatus, the shutter is in the position in which it keeps the opening exposed. On the other hand, as the operator grasps the fixation unit to remove the fixation unit from the image forming apparatus, the shutter is pressed by the operator against the resiliency of the spring, being thereby moved into the position in which it keeps the opening covered. Therefore, the finger of the operator is prevented from entering the fixation unit through the opening, and therefore, the finger of the operator is prevented from coming into contact with the internal components of the fixation unit.

However, the fixation unit disclosed in Japanese Laid-open Patent Application 2004-157511 suffers from the following problem. That is, unless the fixation unit remains grasped by the operator, the opening remains exposed. Therefore, if the operator removes the fixation unit from the image forming apparatus, places the fixation unit on a table, and then, tries to remove the jammed recording medium from the fixation unit, the operator will end up handling the fixation unit while the opening is exposed. Therefore, it is possible that the finger of the operator will come into contact with the internal components, such as the fixation roller, of the fixation unit.

SUMMARY OF THE INVENTION

According to an aspect of the present invention, there is provided an image heating unit detachably mountable to an image forming apparatus. The image heating unit comprises: first and second rotatable members configured to and feed a recording material in an image heating process; a casing enclosing the first and second rotatable member and provided with an opening configured to permit passage of the recording material; a movable member movable relative to the opening between a first position taken when the image heating process is carried out and a second position in which a jam clearance operation is capable through the opening and in which a test finger stipulated in JIS C 0922 probe cord B is prevented from entering through the opening into said casing; and a locking mechanism configured to lock the movable member at the second position.

According to another aspect of the present invention, there is provided an image heating unit detachably mountable to an image forming apparatus. The image heating unit comprises: first and second rotatable members configured to and feed a recording material in an image heating process; a casing enclosing the first and second rotatable member and provided with an opening configured to permit passage of the recording material; a movable member movable relative to the opening between a first position taken when the image heating process is carried out and a second position in which a jam clearance operation is capable through the opening and in which a width of opening measured in a direction substantially perpendicular to a longitudinal direction of the casing is less than 12 mm; and a locking mechanism configured to lock the movable member at the second position.

According to a further aspect of the present invention, there is provided an image forming apparatus comprising (i) an image forming station configured to form an image on a recording material; (ii) a mounting portion; and (iii) an image heating unit detachably mountable to the mounting portion. The image heating unit includes (iii-i) a pair of rotatable members configured to nip and feed the recording material in heating an image formed on the recording material by the image forming station; (iii-ii) a casing enclosing the rotatable members and provided with an opening configured to permit passage of the recording material; (iii-iii) a movable member movable relative to the opening between a first position taken when the image heating process is carried out and a second position in which a jam clearance operation is operable through the opening and in which a test finger stipulated in JIS C 0922 probe cord B is prevented from entering through the opening into the casing; and (iii-iv) a locking mechanism configured to lock the movable member at the second position. The apparatus further comprises (iv) an interrelating mechanism configured to interrelate a locking operation of the locking member with an operation of dismounting the image heating unit from the mounting portion and to interrelate an unlocking operation of the locking mechanism with an operation of mounting the image heating unit to the mounting portion.

According to a further aspect of the present invention, there is provided an image forming apparatus comprising: (i) an image forming station configured to form an image on a recording material; (ii) a mounting portion; and (iii) an image heating unit detachably mountable to the mounting portion. The image heating unit includes (iii-i) a pair of rotatable members configured to nip and feed the recording material in heating an image formed on the recording material by the image forming station; (iii-ii) a casing enclosing the first and second rotatable member and provided with an opening configured to permit passage of the recording material; (iii-iii) a movable member movable relative to the opening between a first position taken when the image heating process is carried out and a second position in which a jam clearance operation is operable through the opening and in which a width of opening measured in a direction substantially perpendicular to a longitudinal direction of the casing is less than 12 mm; and (iii-iv) a locking mechanism configured to lock the movable member at the second position. The apparatus also comprises (iv) an interrelating mechanism configured to interrelate a locking operation of the locking member with an operation of dismounting the image heating unit from the mounting portion and to interrelate an unlocking operation of the locking mechanism with an operation of mounting the image heating unit to the mounting portion.

According to a further aspect of the present invention, there is provided an image heating unit detachably mountable to an image forming apparatus. The image heating unit comprises: first and second rotatable members configured to and feed a recording material; a casing enclosing the first and second rotatable member and provided with an opening configured to permit passage of the recording material; a movable member movable relative to the opening between a first position taken when a recording material feeding process is carried out and a second position in which a jam clearance operation is operable through the opening and in which a test finger stipulated in JIS C 0922 probe cord B is prevented from entering through the opening into the casing; and a locking mechanism configured to lock the movable member at the second position According to a further aspect of the present invention, there is provided an image forming apparatus comprising: (i) an image forming station configured to form an image on a recording material; (ii) a mounting portion; and (iii) an image heating unit detachably mountable to the mounting portion. The image heating unit includes (iii-i) a pair of rotatable members configured to nip and feed the recording material in heating an image formed on the recording material by the image forming station; (iii-ii) a casing enclosing the rotatable members and provided with an opening configured to permit passage of the recording material; and (iii-iii) a shutter configured to open and close the opening. The apparatus further comprises: (iv) a locking member configured to lock the shutter in a closing position; (v) a door opened and closed when the image heating unit is dismounted; and (vi) an interrelating mechanism configured to interrelate a locking operation of the locking member with a closing operation of the door and configured to interrelate an unlocking operation of the locking member with an opening operation of the door.

According to a further aspect of the present invention, there is provided an image forming apparatus comprising: (i) an image forming station configured to form an image on a recording material; (ii) a mounting portion; and (iii) an image heating unit detachably mountable to the mounting portion. The image heating unit includes (iii-i) a pair of rotatable members configured to nip and feed the recording material in heating an image formed on the recording material by the image forming station; (iii-ii) a casing enclosing the rotatable members and provided with an opening configured to permit passage of the recording material; and (iii-iii) a shutter configured to open and close the opening. The apparatus also comprises: (iv) a locking member configured to lock the shutter in a closing position; (v) a door opened and closed when the image heating unit is dismounted; and (vi) an interrelating mechanism configured to interrelate a closing operation of the shutter and a locking operation of the locking member with an opening operation of the door, and to interrelate an unlocking operation of the locking member and an opening operation of the shutter with a closing operation of the door.

Further features of the present invention will become apparent from the following description of exemplary embodiments (with reference to the attached drawings).

BRIEF DESCRIPTION OF THE DRAWINGS

FIG. 10(*b*) is a drawing for illustrating the control section of the apparatus.

DESCRIPTION OF THE PREFERRED EMBODIMENTS

Hereinafter, embodiments of the present invention are described in detail with reference to appended drawings. The following embodiments are described with reference to the recording medium conveying unit and image heating unit of a fixation unit which fixes an unfixed toner image to a sheet of recording medium.

Embodiment 1

Figure 1:
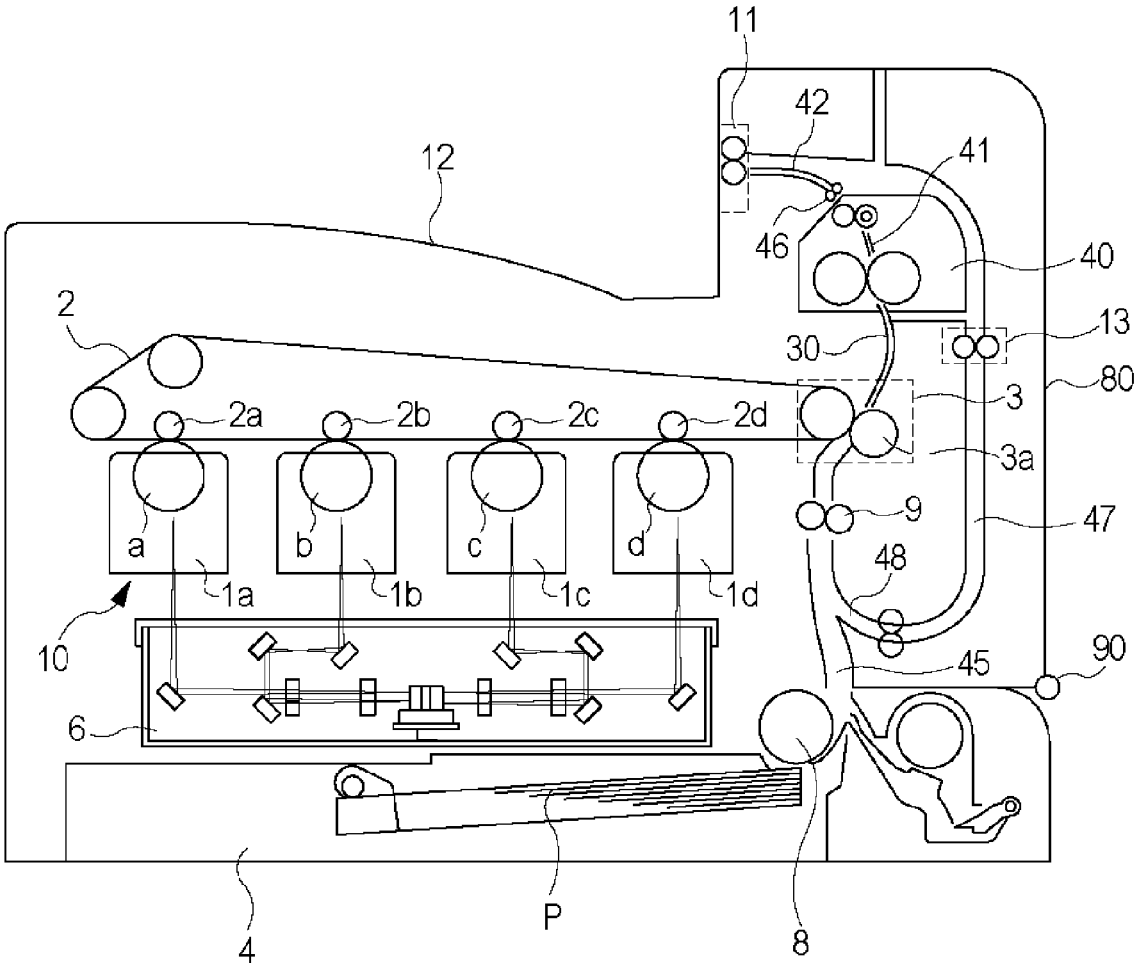
FIG. 1 is a drawing for illustrating the general structure of an image forming apparatus in which a fixation unit in accordance with the present invention is removably installable.

First, referring to FIG. 1, the image forming apparatus in this embodiment is described. FIG. 1 is a drawing for describing the structure of the image forming apparatus in which a fixation unit which functions as both a recording medium conveying unit and an image heating unit is removably installable. This image forming apparatus is full-color laser beam printer. It uses an electrophotographic image formation process. Further, it is of the so-called tandem type.

[Image Forming Apparatus]

Referring to FIG. 1, this image forming apparatus is provided with an image forming portion 10, which forms Y (yellow), M (magenta), C (cyan) and Bk (black) toner images, through a latent image forming process, a developing process, and a transferring process. The image forming portion 10 has image formation units 1*a*, 1*b*, 1*c* and 1*d*, which correspond in color to the monochromatic toner images of the aforementioned colors, one for one, which the image forming portion 10 forms. The image formation units (1*a*, 1*b*, 1*c* and 1*d*) are provided with photosensitive drums a, b, c and d, respectively, as electrophotographic photosensitive members. These photosensitive drums a, b, c and d are charged across their peripheral surface by unshown charging devices. Then, a latent image is formed on the peripheral surface of each of the photosensitive drums a, b, c and d by a laser scanner 6. Then, the latent images are developed by unshown developing devices into toner images. Then, the toner images on the photosensitive drums a, b, c and d are sequentially transferred onto an intermediary transfer belt 2, as an image bearing member, by primary transfer rollers 2*a*, 2*b*, 2*c* and 2*d*. As the intermediary transfer belt 2 is circularly driven, the toner images on the intermediary transfer belt 2 are conveyed to the area of contact between the intermediary transfer belt 2 and a secondary transfer roller 3*a*.

Meanwhile, sheets P of the recording medium in a sheet feeder cassette 4 are moved out of the sheet feeder cassette 4 one by one by a sheet feeder roller 8. Then, each sheet P of the recording medium is conveyed to a pair of registration rollers 9 through a sheet conveyance passage 45, which is on the immediately downstream side of the sheet feeder cassette 4 in terms of the recording medium conveyance direction. The pair of registration rollers 9 catch the sheet P, and temporarily hold the sheet P so that if the sheet P happens to be slanted relative to the recording medium conveyance direction, the sheet P will be corrected in attitude. Then, the pair of registration rollers 9 release the sheet P with such timing that the sheet P will reach the area of contact between the intermediary transfer belt 2 and secondary transfer roller 3*a*, at the same time as the toner images on the intermediary transfer belt 2. Then, the toner images, different in color, on the intermediary transfer belt 2 are transferred onto the sheet P by the secondary transfer roller 3*a* as a transferring member.

Thereafter, the sheet P of the recording medium is sent into the fixation unit 40 through a pre-fixation recording medium conveyance passage 30. Then, the sheet P is conveyed through the fixation unit 40, while being subjected heat and pressure by the fixation unit 40. Consequently, the toner images on the sheet P are fixed to the sheet P.

Here, the sheet P of the recording medium is a medium, on the surface of which a toner image can be formed. Examples of a sheet P of the recording medium are a sheet of ordinary paper, a sheet of resinous substance, a sheet of cardstock, a sheet of film for an overhead projector, etc.

In an image forming operation for forming a toner image on only one of the two surfaces of the sheet P, the sheet P is guided toward a pair of discharge rollers 11 by the switching in position of a flapper 46. Then, the sheet P is discharged by the discharge rollers 11 into a delivery tray 12.

In an image forming operation for forming a toner image on both surfaces of the sheet P, after the fixation of a toner image on one (first) of the two surfaces of the sheet P by the fixation unit 40, the sheet P is conveyed toward the discharge rollers 11. Then, as the trailing edge of the sheet P reaches the reversal point 42, the discharge rollers 11 begin to be rotated in reverse to convey the sheet P backward (switch-backed). Then, the sheet P is conveyed by the switching in position of the flapper 46, through the two-side printing sheet conveyance passage 47. Then, the sheet P is put through the same processes as those through which the sheet P was conveyed for the formation of a toner image on the first surface of the sheet P, to form a toner image on the other surface of the sheet P. Then, the sheet P is discharged into the delivery tray 12. Incidentally, the portion of the image forming apparatus, which is made up of the flapper 46 and discharge rollers 11, is an example of means for turning over the sheet P to form a toner image on both surfaces of the sheet P.

The image forming apparatus requires various maintenance operations, for example, the operation to remove the sheet P stuck in the recording medium conveyance passage of the image forming apparatus. Therefore, the image forming apparatus is provided with a door 80, which is attached to main assembly of the apparatus in such a manner that it can be pivotally moved about a hinge 90 of the main assembly, in the clockwise direction indicated in FIG. 1.

By the way, in the case of the image forming apparatus in this embodiment, its pre-fixation recording medium passage 30, secondary transfer roller 3*a*, and one (right one in FIG. 1) of the pair of registration rollers 9 are attached to the door 80. Therefore, as the door 80 is opened, the recording medium conveyance passage, which is made up of the recording medium passage 45, which is on the immediately downstream side of the sheet feeder cassette 4, in terms of the recording medium conveyance direction, and extends to the pair of discharge rollers 11, is exposed, except for the portion in the fixation unit 40. Further, as the door 80 is opened, it becomes possible for an operator to install the fixation unit 40 into the unshown fixation unit chamber of the image forming apparatus, or uninstall the fixation unit 40 from the fixation unit chamber.

That is, the door 80 functions as such a door that can take a closed position in which it prevents the image heating unit from being installed into, or uninstalled from, the fixation unit chamber, and an open position in which it allows the image heating unit to be installed into, or uninstalled from, the fixation unit chamber.

[Fixation Unit]

Next, the fixation unit 40 in this embodiment is described. The fixation unit 40 in this embodiment is removably installable in the image forming apparatus. It functions as both the recording medium conveying unit and image heating unit. This fixation unit 40 is an integration of the structural components of the fixing device for the image forming apparatus. It is removably installable in the image forming apparatus. Therefore, if it becomes necessary for a given component (or components) of the fixing device to be replaced, the entirety of the fixation unit can be replaced to make it easy to replace the component(s). In addition, if a sheet P (or sheets P) of the recording medium happens to jam the fixing portion, and therefore, has to be removed, the fixating portion, which is in the form of the fixation unit, can be removed from the image forming apparatus to make it easier to remove the jammed sheet P.

One of the characteristic features of the fixation unit in this embodiment described above is that it is provided with a sliding cover which covers the recording medium conveyance opening of the fixation unit 40, in such a manner that the jammed sheet(s) P can be removed, and a locking mechanism for locking or unlocking the sliding cover. This structural arrangement prevents the finger(s) of an operator from coming into contact with the internal components, such as the fixation roller, in the fixation unit, when the operator tries to remove the jammed sheet(s) P, for example. Hereafter, the structure of this fixation unit is described in detail with reference to the drawings.

Figure 2:
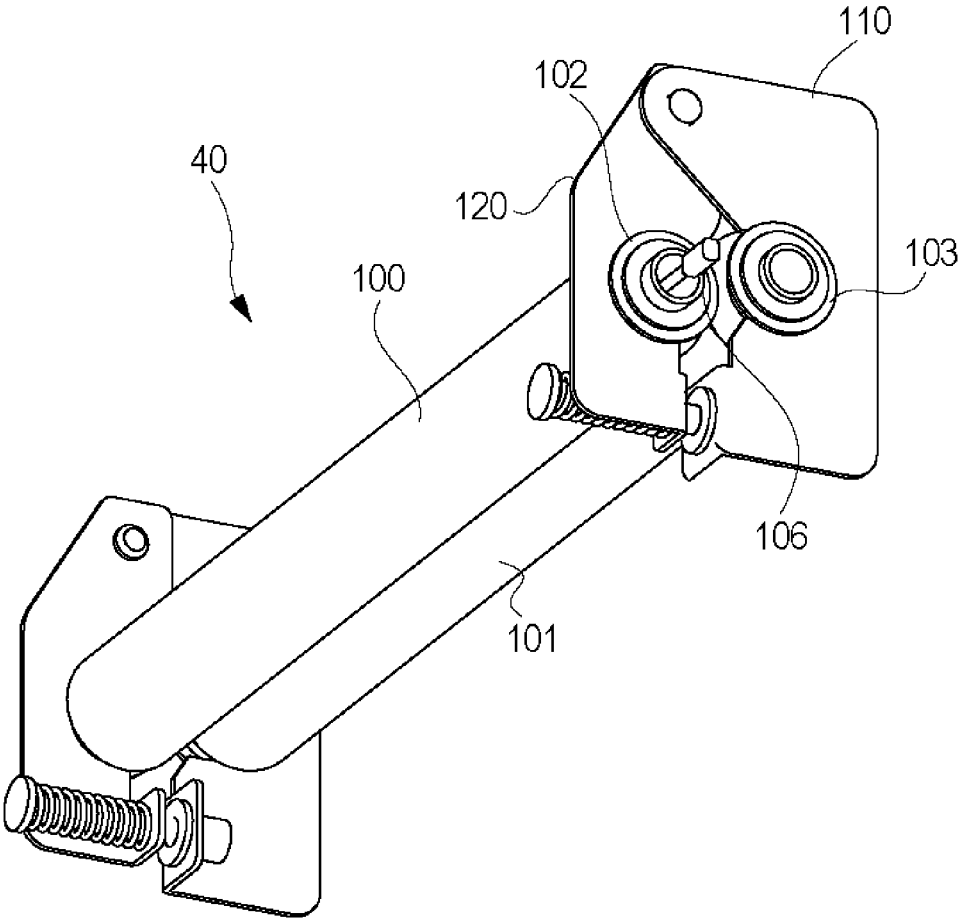
FIG. 2 is a drawing for illustrating the internal components of the fixation unit.
Figure 3:
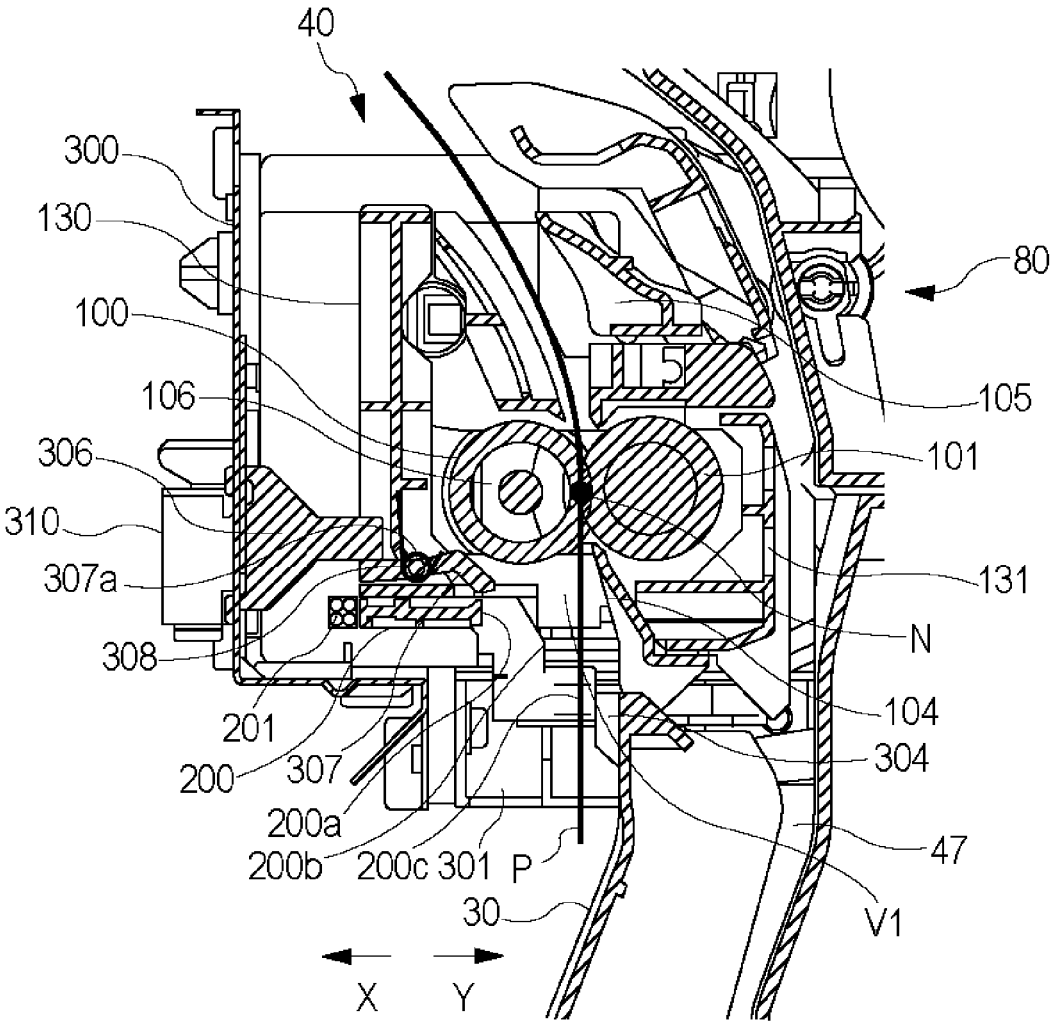
FIG. 3 is a drawing for illustrating the state in which the fixation unit in the first embodiment of the present invention is when the fixing unit is in the image forming apparatus, and the door of the image forming apparatus is closed.

FIG. 2 is a drawing for illustrating the internal components of the fixation unit. FIG. 3 is a drawing for illustrating the state of fixation unit after the proper installation of the fixation unit into the image forming apparatus, and also, after the closing of the door. Hereafter, referring to FIGS. 2 and 3, the fixation unit 40 is described in detail.

Referring to FIG. 2, the fixation unit 40 is provided with a pair of rollers, more specifically, a fixation roller 100 and a contact roller 101, which are for heating and pressing the unfixed toner image on a sheet P of the recording medium to fix the toner image to the sheet P. The fixation roller 100 is a cylindrical hollow component, and has a parting layer, as a surface layer, which is low in coefficient of friction. It has a heating member 106, in its hollow. The contact roller 101 also is a cylindrical hollow member, and has a parting layer, as a surface layer, which is low in coefficient of friction. It is positioned in parallel to the fixation roller 100 so that its peripheral surface is placed in contact with that of the fixation roller 100 and forms a nip N as shown in FIG. 3. The contact roller 101 is supported by a pair of supporting members 110, with the placement of a pair of contact roller bearings 103 between the contact roller 101 and supporting members 110, one for one. The fixation roller 100 is supported by a pair of pressure application levers 120, with the placement of a pair of fixation roller bearings 102, one for one. Normally, therefore, a preset amount of contact pressure is maintained between the fixation roller 100 and contact roller 101 by the pressure application levers 120 (which hereafter will be referred to simply as "pressure levers").

Next, referring to FIG. 3, the fixation roller 100 and contact roller 101 are rotated in the counterclockwise and clockwise directions (in FIG. 3), respectively, by an unshown driving mechanism. Thus, as a sheet P of the recording medium is sent to the upstream end (bottom end in FIG. 3) of the nip N, in terms of the recording medium conveyance direction, it is conveyed through the nip N to the downstream end (top end in FIG. 3) of the nip N, while remaining pinched between the fixation roller 100 and contact roller 101. While the sheet P is conveyed through the nip N, the image on the sheet P is heated and pressed by the fixation roller 100 and contact roller 101. Thus, the image on the sheet P is fixed to the sheet P. That is, the fixation roller 100 and contact roller 101 cooperate to thermally fix the image to the sheet P.

Here, the fixation roller 100 and contact roller 101 function as a pair of rotational members which heat the image on the sheet P of the recording medium while conveying the sheet P through the nip N which they form.

Further, the fixation roller 100 and contact roller 101 function as a pair of rotational members which convey the sheet P of the recording medium while keeping the sheet P pinched between them.

The above-described structural components of the fixation unit 40 are internally held by a combination of a fixation unit frame 130 and a fixation unit cover 131, which are in connection to each other. The combination of fixation unit frame 130 and fixation unit cover 131 functions as a casing for enclosing the above described structural components of the fixation unit, and prevents the structural components from coming into contact with the foreign objects to protect them. Therefore, the internal components such as the fixation roller 100 are unlikely to be damaged. Further, the possibility that an operator will come into contact with the internal components when the components are hot is minimized.

The combination of the fixation unit frame 130 and fixation unit cover 131 forms an opening as an entrance through which a sheet P of the recording medium can be introduced into the nip N through the upstream conveyance passage 30. Thus, the shape of the opening is such that its lengthwise edges are parallel to the axial line of the fixation roller 100.

To describe in further detail, the fixation unit cover 131 has an entrance guide 104 for guiding a sheet P of the recording medium into the fixation unit 40. The entrance guide 104 is positioned so that it will be on the upstream side of the nip N when it is closed. That is, the opening is formed by the entrance guide 104, and the fixation unit frame 130, which is on the opposite side of the opening from the entrance guide 104. The shape of the opening is such that the lengthwise direction of the opening is parallel to the axial line of the fixation roller 100, and the widthwise direction of the opening is parallel to the direction in which the sheet P of the recording medium is conveyed. Referring to FIG. 3, the width of the opening is equivalent to a gap V1. This gap V1 is set to prevent the problem that when a sheet P of the recording medium having an unfixed toner image is introduced into the fixation unit 40 to fix the unfixed toner image, the unfixed toner image is disturbed by coming into contact with the fixation roller 100. Thus, it is set based on the predictable amount by which a sheet P of the recording medium may curl. Incidentally, the value of the gap V1 in this embodiment is roughly 20 mm.

Therefore, the combination of the fixation unit frame 130 and fixation unit cover 131 has the opening which allows a sheet P of the recording medium to enter the fixation unit 40. Further, it functions as a casing which internally holds the pair of rotational members 100 and 101.

The fixation unit 40 is provided with a sliding cover 200, which is on the upstream side of the nip N, and on the opposite side of the recording medium conveyance passage from the entrance guide 104, extending in the lengthwise direction of the opening. The sliding cover 200 is supported by the fixation unit frame 130 in such a manner that it can be linearly moved in the direction indicated by arrow marks X and Y in the drawing. It is kept pressed in the direction Y, that is, toward the entrance guide 104, by a pair of sliding cover springs 201 located at the lengthwise ends of the sliding cover 200, one for one.

Therefore, the sliding cover 200 functions as a moving member (shutter) which is movable relative to the opening. Further, the sliding cover 200 is slidable in the direction which is practically perpendicular to the lengthwise direction of the casing (combination of fixation unit frame 130 and fixation unit cover 131). Moreover, the sliding cover springs 201 functions as pressing member for pressing the sliding cover 200.

[Locking Mechanism]

Next, referring to FIGS. 3 to 6, the locking mechanism which locks or unlocks the sliding cover 200 is described about its structure.

Figure 4:
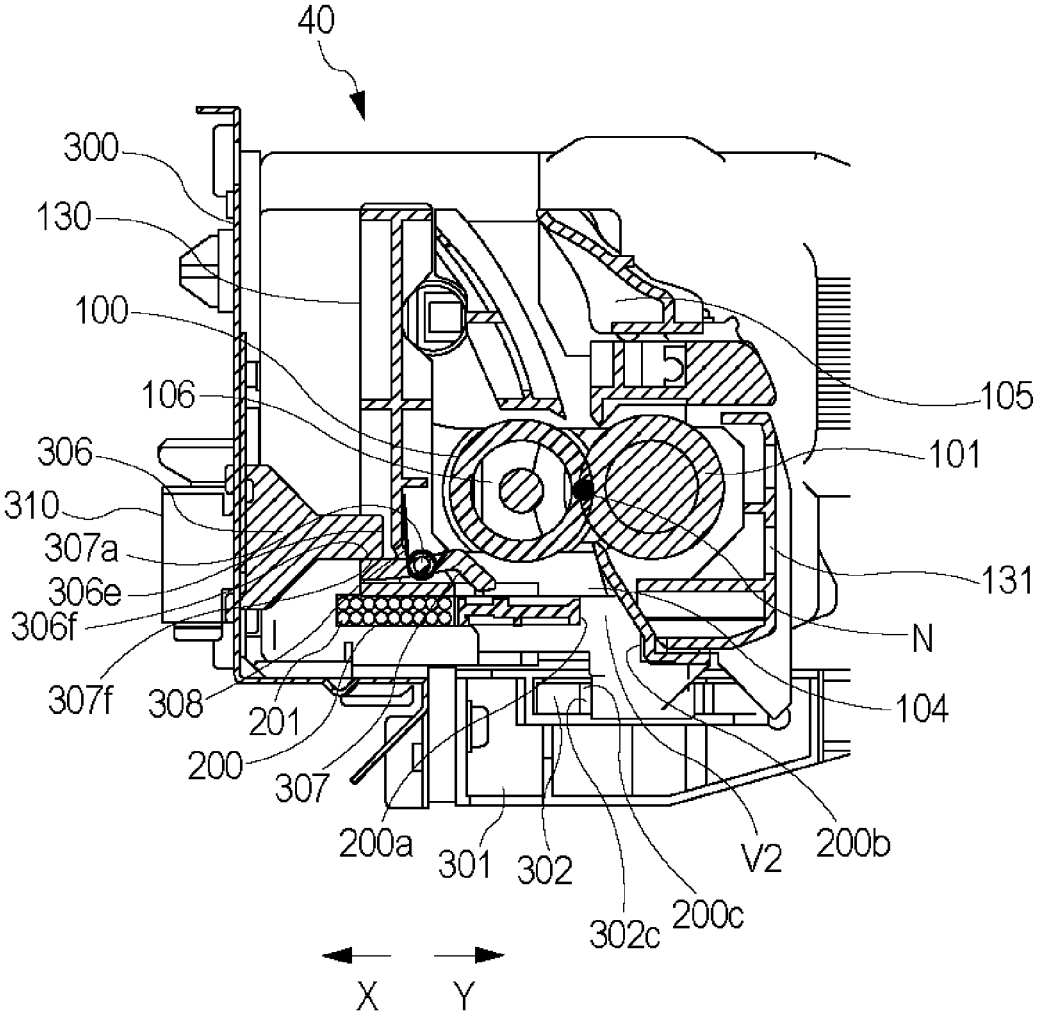
FIG. 4 is a drawing for illustrating the state in which the fixation unit in the first embodiment is when the fixation unit is in the image forming apparatus and the door of the image forming apparatus is open.
Figure 5:
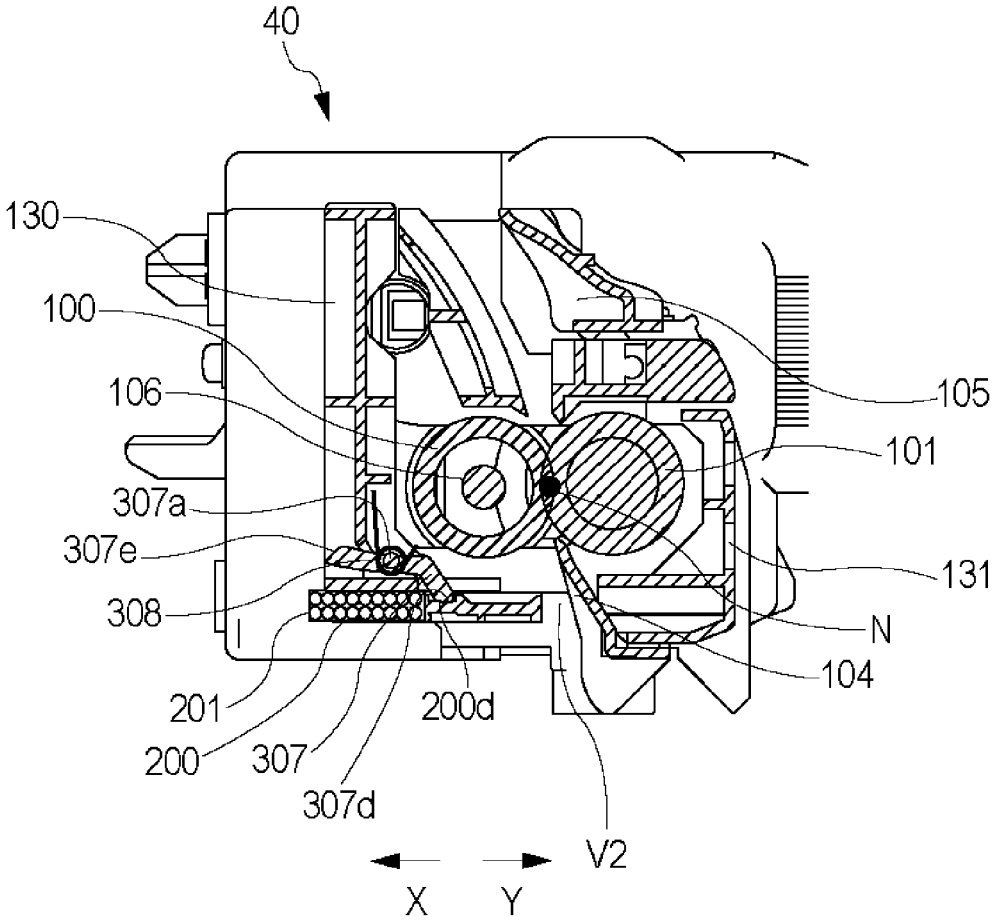
FIG. 5 is a drawing for illustrating the state in which the fixation unit in the first embodiment is when the fixation unit is out of the image forming apparatus.
Figure 6:
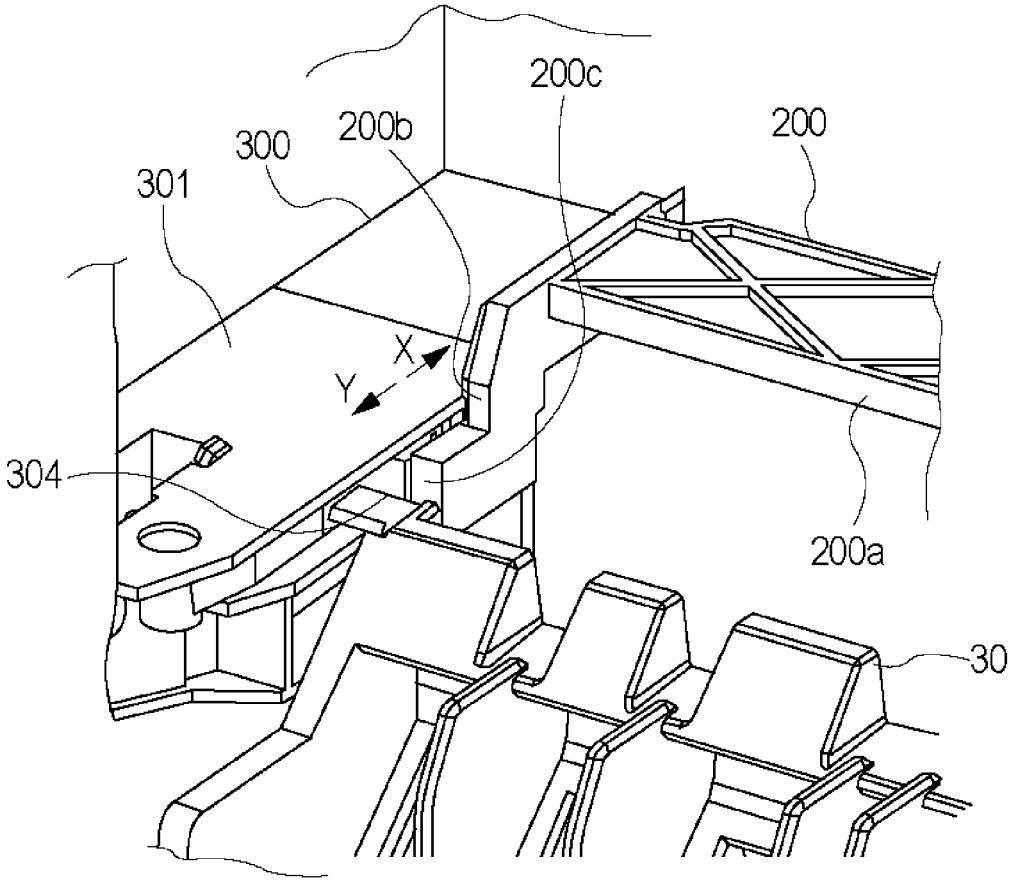
FIG. 6 is a drawing for illustrating the states in which the sliding cover the fixing unit, and locking mechanism of the image forming apparatus are when the fixation unit is in the image forming apparatus.

FIG. 3 is a drawing for illustrating the state of the fixation unit 40 in this embodiment is when the fixation unit is in the image forming apparatus and the door of the image forming apparatus is closed. FIG. 4 is a drawing for illustrating the state of if which the fixation unit 40 in this embodiment when the fixation unit is in the image forming apparatus and the door of the image forming apparatus is open. FIG. 5 is a drawing for illustrating the state of if which the fixation unit 40 in this embodiment when the fixation unit 40 is out of the image forming apparatus. FIG. 6 is a drawing for illustrating the state of which the sliding cover of the fixation unit, and the locking mechanism of the image forming apparatus, when the fixation unit is in the image forming apparatus.

Referring to FIG. 3, the main apparatus frame 300 of the image forming apparatus is provided with a fixation unit supporting member 301, and a fixation unit holding mechanism 310. The fixation unit supporting member 301 supports the fixation unit 40 by the bottom surface of the fixation unit 40 against the weight of the fixation unit 40. The fixation unit holding mechanism 310 keeps the fixation unit 40 properly positioned by properly positioning the lengthwise ends of the fixation unit 40.

When the fixation unit 40 is properly positioned in the main assembly of the image forming apparatus, it remains on the fixation unit supporting member 301, and remains fixed to the main assembly frame 300 by being pressed upon the main assembly frame 300 by the fixation unit holding mechanism 310. In this case, the combination of the fixation unit supporting member 301 and fixation unit holding mechanism 310 functions such a section that enables the fixation unit 40 to be properly installed into, or uninstalled from, the main assembly frame 300.

Referring to FIG. 3, fixation unit 40 is provided with an upstream locking lever 307 and an upstream lock spring 308. The upstream locking lever 307 locks the sliding cover 200 to prevent the sliding cover 200 from moving. The upstream lock spring 308 provides the upstream locking lever 307 with the force which keeps the upstream locking lever 307 in its locking position. The upstream locking lever 307 is held by the fixation unit frame 130 so that it can be pivotally moved about its pivot 307*a*. It is under the pressure generated by the upstream locking spring 308 in the direction to pivotally move the upstream locking lever 307 in the clockwise direction of the drawing.

In other words, the combination of the upstream locking lever 307 and the upstream locking spring 308 functions as a locking mechanism.

The frame 300 of the main assembly of the image forming apparatus is provided with a locking lever disengaging lever 306 for disengaging the upstream locking lever 308. The locking lever disengaging lever 306 is shaped so that it protrudes in the direction in which the fixation unit 40 is inserted into, or removed from, the main assembly of the printer. It is positioned so that when the fixation unit 40 is in its image forming position in the image forming apparatus, it remains in contact with the upstream locking lever 307.

The upstream recording medium passage 30, with which the door 80 is provided, is provided with a pair of protrusions 304, which correspond in position to the lengthwise ends of the fixation unit 40, one for one. The protrusion 304 are positioned so that as the door 80 is closed, the protrusions 304 are made to move the sliding cover 200 by the movement of the upstream recording medium passage 30. As the fixation unit 40 is pulled out of the fixation unit chamber in the direction Y, the fixation unit engaging portion 302 of the main assembly separates (disengages) from the main assembly engaging portion 200*c* of the sliding cover 200.

The fixation unit engaging portion 302, shown in FIG. 6, engages with the main assembly engaging portion 200*c* of the fixation unit 40 to prevent the sliding cover 200 from moving after the installation of the fixation unit 40 into the main assembly of the image forming apparatus.

Next, referring to FIG. 3, the state in which the fixation unit 40 is when it is capable of thermally fixing an unfixed image on a sheet P of the recording medium is described.

Referring to FIG. 3, when the fixation unit 40 is in the state in which it can heat the image on a sheet P of the recording medium, it is in the main assembly of the image forming apparatus, and the door 80 is shut. Further, the upstream recording medium passage 30 is in the proper position for image formation.

Further, the fixation unit 40 remains held to the main assembly frame 300 by the fixation unit holding mechanism 310. As for the upstream locking lever 307, its end portion 307*f* which protruding from the fixation unit frame 130, remains pressed by the locking lever disengaging member 306. Therefore, the upstream locking lever 307 is in the position into which it has been pivotally moved in the counterclockwise direction (in drawing) about the pivot 307*a* by the end portion 307*f* against the resiliency of the upstream locking spring 308. When the fixation unit 40 is in this state, the locking surface 307*d* of the upstream locking lever 307, which is on the sliding cover side of the upstream locking lever 307, is in its retreat in which it does not contact the sliding cover 200. Therefore, it does not interfere with the movement of the sliding cover 200.

Further, the door 80 will have been closed against the main assembly of the image forming apparatus. Therefore, the upstream recording medium conveyance passage 30 will be in its preset position. At this point in the operation, the protrusion 304 of the door 80 is pressing on the surface 200*c* of the sliding cover 200, which is the upstream surface in terms of the direction, indicated by the arrow mark X, in which the door 8 is closed. Thus, this pressure from the protrusion 304 keeps the sliding cover 200 disengaged from the locking mechanism, moves the sliding cover 200, and keeps the sliding cover 200 open. That is, the recording medium conveyance passage 30 is kept in the state in which it is provided with the gap V1. Therefore, it does not occur during the thermal fixation of an unfixed image that the unfixed image comes into contact with the fixation unit frame 130. Therefore, it does not occur during the thermal fixation of the unfixed image that the unfixed image is disturbed by coming into contact with the fixation unit frame 130.

That is, when the door 80 is in its closed position, the sliding cover 200 is kept in its first position, or the position for thermal image fixation, by the door 80.

Next, referring to FIGS. 4 and 6, what occurs as the door 80 is moved in the opening direction when it is in the above described position is described.

As the door 80 is moved in its opening direction indicated by an arrow mark Y when it is in the position in which it enables the fixation unit 40 to thermally fix an unfixed image, the upstream recording medium passage 30 is moved by the movement of the door 80, in the same direction, indicated by the arrow mark Y, as the door 80. Thus, the protrusions 304 also are moved in the same direction, indicated by the arrow mark Y, as the door 80.

Next, referring to FIG. 6, as the door 80 is moved as described above, the sliding cover 200, which is in contact with the protrusions 304, is moved by the resiliency of the sliding cover springs 201 in the direction Y, which is the same direction as the direction in which the sliding cover 200 moves when it closes the recording medium conveyance direction. Thus, the lengthwise end portions of the sliding cover 200, which are outside the recording medium conveyance passage, come into contact with the entrance guide 104. Since the lengthwise ends of the sliding cover 200 are protruding toward the entrance guide 104 beyond the sheet conveyance portion 200*a*, the sliding cover 200 is held by the protrusions 304, without completely closing the recording medium conveyance passage, which is between the portion 200*a* and entrance guide 104.

Further, the engaging portion (surface portion) 200*c* of the sliding cover 200 becomes engaged with the sliding cover engaging portion 302*c* of the main assembly of the image forming apparatus, which is shown in FIG. 4. Thus, the sliding cover 200 is regulated in movement; it is locked in position. Therefore, it does not occur that when the door 80 is open, the sliding cover 200 is pushed open by an operator.

Next, referring to FIGS. 4 and 5, what occurs when the fixation unit 40 is installed into, or uninstalled from, the main assembly of the image forming apparatus is described.

In an operation for removing the fixation unit 40 from the main assembly frame 300, the state of the fixation unit 40 changes from the state shown in FIG. 4 to the state shown in FIG. 5.

As the fixation unit 40 in the fixation unit chamber of the main assembly frame is moved in the direction Y, or the direction in which the fixation unit 40 is to be pulled out of the main assembly frame, the fixation unit engaging portion 302 of the apparatus main assembly disengages from the main assembly engaging portion 200*c* of the sliding cover 200. Further, the upstream locking lever 307, shown in FIG. 4, with which the fixation unit 40 is provided, separates from the locking lever disengaging member 306. As the upstream locking lever 307 separates from the locking lever disengaging member 306, it is pivotally moved about the pivot 307*a* by the resiliency of the upstream lock spring 308. Consequently, the locking surface 307*d* of the upstream locking lever 307 comes into contact with the locking surface 200*d* of the sliding cover 200, preventing thereby the sliding cover 200 from moving in the direction X. That is, the sliding cover 200 is locked in position. In other words, even though the sliding cover 200 is free from the sliding cover engaging portion 302, it remains locked by the upstream locking lever 307. Therefore, it does not occur that the sliding cover 200 is pushed open by an operator.

It is through the above described steps that the fixation unit 40 comes out of the image forming apparatus.

By the way, when the lengthwise end portions 200*b* are in contact with the entrance guide 104, the gap V2 between the portion 200*a* of the sliding cover 200 and the entrance guide 104 is narrower than the above described gap V1. More specifically, the gap V2 is small enough to prevent a finger (fingers) of an operator from entering the fixation unit 40 through the opening (gap V2). Assuming here that an operator is an adult of the normal size, it is reasonable to liken a double-jointed cylindrical probe (JIS C 0922 Probe Code B, IEC 61032, test probe B), which is 12 mm in diameter, to a finger of the operator. This probe is referred to as "test finger". Its specifications are set by JIS (Japanese Industrial Standard) IEC (International Electric Standard Conference). The two sets of specifications are identical.

The above-described gap V1 is 20 mm. Therefore, if the fixation unit 40 is removed from the image forming apparatus without changing the gap V1 in size, the test finger can be put through the gap V1. Thus, all that is necessary to make it impossible for the test finger to be put through the gap V1 when the fixation unit 40 is out of the image forming apparatus is to move the sliding cover 200 to make the gap V2 become no more than 12 mm, for example, as the fixation unit 40 is removed from the image forming apparatus. With the gap V2 being no more than 12 mm, it is possible to prevent an operator from touching the internal components, such as the fixation roller, of the fixation unit 40, when the fixation unit 40 is out of the image forming apparatus.

Further, it is possible that when the fixation unit 40 is out of the image forming apparatus, and therefore, is completely exposed, a child will touch the fixation unit 40. Therefore, it is desired that a double-jointed cylindrical probe (JIS C 0922 Probe Code 19, IEC 61032, test probe 19), which is 5.6 mm in diameter, and therefore, can be likened to a finger of an infant, cannot be put through the opening. For example, all that is necessary is to structure the fixation unit 40 so that the sliding cover 200 is movable to make the gap V2 become no more than 5.6 mm.

Incidentally, the reason why the gap V2 is provided is as follows. That is, it is for making it possible for an operator to remove jammed object(s) when the fixation unit 40 is out of the image forming apparatus. If the gap V2 is not provided, it is possible that a jammed sheet P will be pinched between the sliding cover 200 and entrance guide 104, and there, it will be difficult for the jammed sheet P to be removed (pulled out). In addition, a sheet P having wrapped around the fixation roller 100 will be confined on the inward side of the sliding cover 200, and therefore, will be difficult to remove. Therefore, it is desired that the gap V2 is greater than the thickness of the thickest sheet P of the recording medium which can be introduced into the fixation unit 40.

Therefore, the sliding cover 200 is enabled to take a second position in which it allows a sheet P of the recording medium to be removed from the fixation unit 40 through the opening, and yet, prevent the test finger from being put through the opening.

Further, the sliding cover 200 is slid between the first and second positions to regulate the dimension of the opening, in terms of the thickness direction of a sheet P of the recording medium which is conveyed through the gap.

Further, the sliding cover spring 201 keeps the sliding cover 200 continuously pressed in the direction to move the sliding cover 200 from the first position to the second position.

Further, the sliding cover 200 functions as a component which is movable relative to the opening. It can take the second position in which it makes the opening no more than 12 mm in dimension in terms of the thickness direction of a sheet P of the recording medium which is conveyed through the opening, and the first position which is the position for image heating, and in which it makes the opening greater in dimension than the second position.

Further, the sliding cover 200 functions as a component which can be moved relative to the opening. It can take the first position which is for image heating, and the second position which is for allowing a sheet P of the recording medium to be removed through the opening, and yet, preventing the test finger (JIS C 0922 Probe Code B) from entering the opening.

Further, the sliding cover 200 functions as a movable component which can be moved into the second position in which it regulates the aforementioned width to no more than 5.6 mm.

Further, the sliding cover 200 functions as a component movable to the second position in which it prevents the test finger (JIS C 0922 Probe Code 19) from passing through the gap.

Further, the upstream locking lever 307 functions as a locking component which locks the sliding cover 200 in position when the sliding cover 200 is in the second position.

During the operation for installing the fixation unit 40 into the main assembly frame 300, the state of the fixation unit 40 changes from the state shown in FIG. 5 to the state shown in FIG. 4.

As the fixation unit 40 is moved in the direction X to be installed into the fixation unit chamber in the main assembly frame 300, the upstream locking lever 307 comes into contact with the locking lever disengaging member 306. More concretely, the locking lever contacting portion 306*e* of the locking lever disengaging member 306 comes into contact with the tapered portion 307*e* of the upstream locking lever 307, and presses the upstream locking lever 307 against the resiliency of the upstream locking spring 308.

Thus, the upstream locking lever 307 pivots about its pivot 307*a* in the counterclockwise direction, shown in the drawing. When the fixation unit 40 is in this state, the upstream locking lever 307 is in the position in which its locking surface 307*d* does not contact the locking surface 200*d* of the sliding cover 200. Then, as the fixation unit 40 is moved into the preset position in the main assembly frame 300, the upstream locking lever 307 is moved into the position in which the locking disengaging surface 307*f* of the upstream locking lever 307 contacts the lever contacting surface 306*f* of the lock disengaging member 306. Thereafter, the upstream locking lever 307 is held in the position in which it remains disengaged from the sliding cover 200.

In other words, the lock disengaging member 306, upstream locking lever 307, and upstream locking spring 308 function in concert as a linkage for locking or unlocking the sliding cover 200.

This linkage causes the installation of the fixation unit 40 into the fixation unit holding mechanism 310, to unlock the sliding cover 200.

Further, the linkage causes the uninstallation of the fixation unit 40 from the fixation unit holding mechanism 310, to lock the sliding cover 200.

According to this embodiment, there is no possibility that a finger of an operator will come into contact with the internal components of the fixation unit 40, when the fixation unit 40 is out of the image forming apparatus.

According to this embodiment, there is no possibility that a finger of an infant will come into contact with the internal components of the fixation unit 40, when the fixation unit 40 is out of the image forming apparatus.

Also according to this embodiment, there is no possibility that the sliding cover 200, which is covering the opening, is pushed open by an operator, when the fixation unit 40 is out of the image forming apparatus.

Also according to this embodiment, a sheet P of the recording medium can be removed from the fixation unit 40, when the fixation unit 40 is out of the main assembly of the image forming apparatus.

Lastly, according to this embodiment, it is on the recording medium entrance side of the fixation unit 40 that the above described effects can be obtained.

Embodiment 2

Next, the structure of the fixation unit in the second embodiment of the present invention is described. This embodiment is different from the first one in that the object to be locked in position in this embodiment is the exit guide located at the opening of the fixation unit, which is on the downstream side of the fixation nip N, instead of the sliding cover 200 located at the opening of the fixation unit, which is on the upstream side of the nip N. However, it is the same in gist as the first embodiment. By the way, the components in this embodiment, which are similar in function to the counterparts in the first embodiment, are given the same reference codes as those given to the counterparts, and are not going to be described.

[Fixing Device]

Next, the fixing device in this embodiment is described. The fixing device in this embodiment is in the form of a fixation unit 40, as an image heating unit, which is a combination of a recording medium conveying unit and an image heating unit. It is removably installable in an image forming apparatus. This fixation unit 40 is an integration of the structural components of the fixing device. If it becomes necessary for a component (or components) of the fixing device to be replaced, the entirety of the fixation unit can be replaced. Therefore, it makes it easier to replace the component. Further, if a sheet of recording medium becomes jammed in the fixing portion of the fixation unit 40, and therefore, it becomes necessary to remove the jammed recording medium from the fixing portion, the fixing portion can be moved out of the image forming apparatus by removing the fixation unit 40 out of the image forming apparatus. Therefore, this fixation unit 40 makes it easier to remove the jammed recording medium.

One of the characteristic features of the above described fixation unit in this embodiment is that it is provided with an exit guide and a locking mechanism. The exit guide which is disposed on the downstream side of the fixation unit 40 to guide a sheet P of the recording medium as the sheet P comes out of the fixation unit 40, so that the jammed sheet can be removed. The locking mechanism is for locking the exit guide in position. This structural arrangement prevents the problem that as an operator tries to remove a jammed sheet of the recording medium, for example, from the fixation unit, a finger of the operator comes into contact with the internal components of the fixation unit 40, when the fixation unit 40 is out of the image forming apparatus. Hereafter, the structure of this fixation unit 40 is described in detail with reference to the appended drawings.

Referring to FIG. 2, the fixation unit 40 in this embodiment is provided with a fixation roller 100 and a contact roller 101, which are for fixing an image on a sheet of the recording medium, in the nip N. It is also provided with a fixation unit frame 130 and a fixation unit cover 131, which integrally support and cover the fixation roller 100 and contact roller 101. The fixation unit frame 130 and fixation unit cover 131 form an opening, through which a sheet P of the recording medium is conveyed toward a downstream sheet conveyance passage 31 after being discharged from the nip N.

Figure 7:
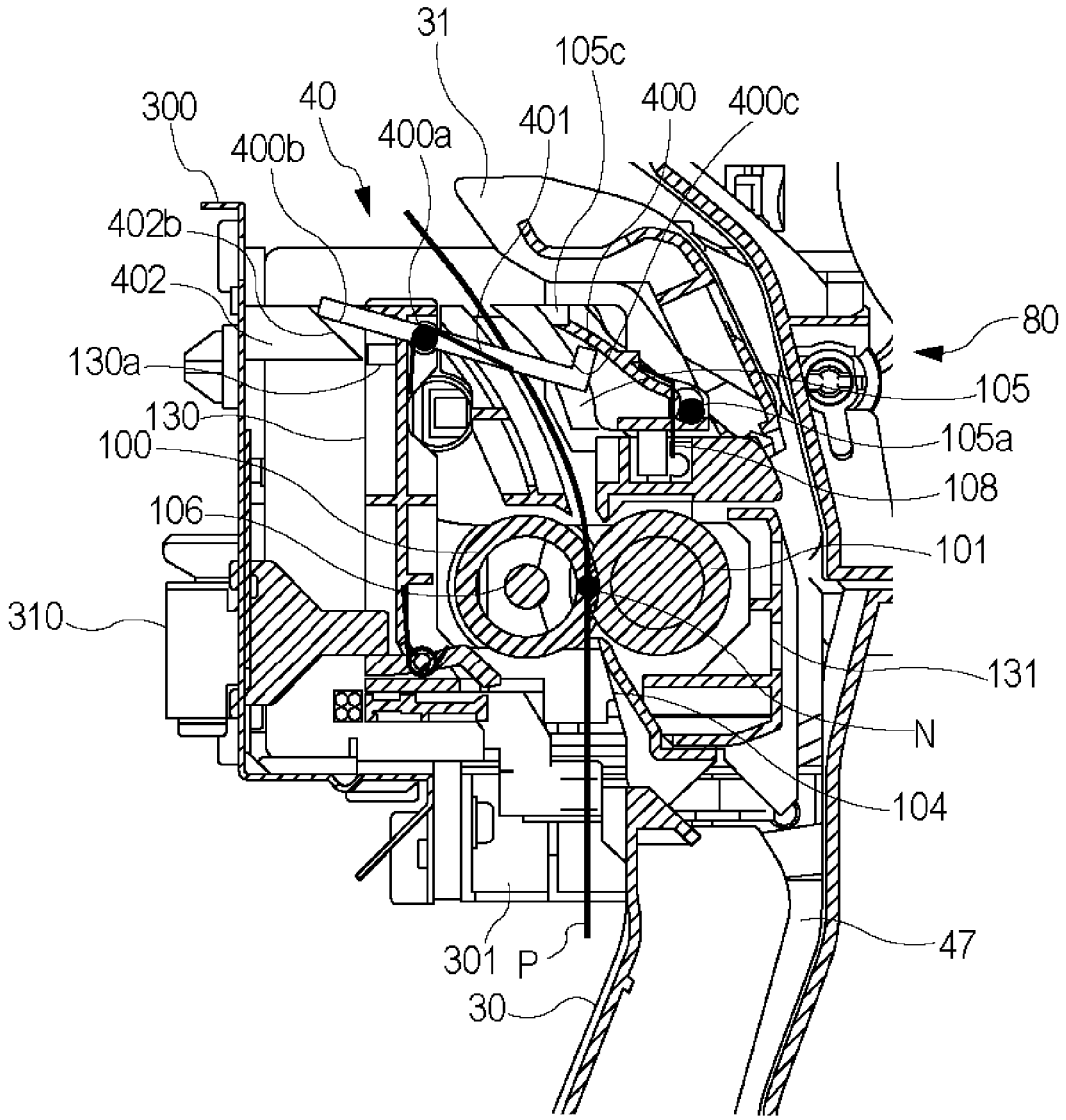
FIG. 7 is a drawing for illustrating the states in which the fixation unit in the second embodiment of the present invention is when the fixation unit is in the image forming apparatus and the door of the image forming apparatus is closed.

Referring to FIG. 7, in this embodiment, the fixation unit cover 131 is provided with an exit guide 105 which assists the recording medium conveyance. The fixation unit cover 131 is disposed in the adjacencies of the opening of the fixation unit 40, which is on the downstream side of the nip N. The exit guide 105 plays the role of directing a sheet P of the recording medium to guide outward the sheet P as the sheet P comes out of the nip N while remaining pinched between the fixation roller 100 and contact roller 101. More specifically, when it is in its closed position, it functions as a component for guiding the sheet P as the sheet P is discharged from the fixation unit 40 through the downstream opening of the fixation unit 40.

There is an opening between this exit guide 105, and the fixation unit frame 130, which is on the opposite side of the recording medium passage 31 from the exit guide 105. The opening has preset width and depth. The width of this opening is set to prevent the problem that as a sheet of the recording medium is conveyed through this opening immediately after the fixation of the image thereon, the image on the sheet P is disturbed by coming into contact with the fixation unit frame 130. It is set based on the predictable amount by which a sheet of the recording medium curls. The width of this downstream opening is desired to be such that it prevents a finger of an operator from accidentally entering the opening, as in the first embodiment. Assuming here that an operator is an adult of the normal size, it is reasonable to liken a double-jointed cylindrical probe (JIS C 0922 Probe Code B, IEC 61032, test probe B), which is 12 mm in diameter, to a finger (fingers) of the operator. This probe is referred to as "test finger". Its specifications are set by JIS (Japanese Industrial Standard) IEC (International Electric Standard Conference). Thus, all that is necessary to make it impossible for the test finger to be put through the opening when the fixation unit 40 is out of the image forming apparatus is to move the exit guide 105 to make the opening no more than 12 mm in width, for example. With the opening being no more than 12 mm in width, it is possible to prevent an operator from touching the internal components of the fixation unit 40, when the fixation unit 40 is out of the image forming apparatus.

Further, it is possible that when the fixation unit 40 is out of the image forming apparatus, and therefore, is completely exposed, a child will touch the fixation unit 40. Therefore, it is desired that a double-jointed cylindrical probe (JIS C 0922 Probe Code 19, IEC 61032, test probe 19), which is 5.6 mm in diameter, and therefore, can be likened to a finger of an infant, cannot be put through the opening. For example, all that is necessary is to structure the fixation unit 40 so that the exit guide 105 is movable to make the opening become no more than 5.6 mm in width.

Incidentally, it is desired that when the fixation unit 40 is the image forming apparatus, the exit guide 105 remains in the position in which it prevents a finger of an operator from entering the downstream opening of the fixation unit 40 as the sliding cover 200 remains in the position in which it prevents a finger of an operator from entering the upstream opening of the fixation unit 40 in the first embodiment. However, as long as a finger of an operator is prevented from entering the downstream opening of the fixation unit 40, the fixation unit 40 does not need to be structured as in this embodiment. For example, the fixation unit 40 may be structured as follows.

The exit guide 105 is pivotally movable about a hinge 105*a* in the direction indicated by an arrow mark U, and is kept under the pressure generated by an exit guide spring 108 in the opposite direction from the direction indicated by the arrow mark U.

Therefore, normally, the exit guide 105 remains in its closed position. However, it can be pivotally opened in the direction U by applying pressure to the exit guide 105 against the resiliency of the exit guide spring 108. With the provision of this structural arrangement, it is possible for an operator to insert his or her finger into the unshown gap between the main assembly of the image forming apparatus and the fixation unit 40. Therefore, the operator can easily remove a jammed sheet P of the recording medium when a sheet P of the recording medium has jammed the recording medium passage. More concretely, as an operator tries to pull the sheet P of the recording, which is protruding downstream from the nip N, out of the fixation unit 40, by grasping the sheet P with his or her fingers inserted through the gap, the exit guide 105 is pivotally opened in the direction U by being pushed by the sheet P, which is being moved out in the direction Y. Therefore, the exit guide 105 does not interfere with the movement of the sheet P.

During this operation, the downstream opening is widened enough for a finger of an operator to enter. However, as the exit guide 105 is pivotally moved in the direction U, the gap between the image forming apparatus and fixation unit 40 narrows.

[Locking Mechanism]

Next, referring to FIG. 7, the mechanism for locking the exit guide 105 in this embodiment is described. FIG. 7 is a drawing for illustrating the state in which the fixation unit 40 in the second embodiment is when the fixation unit 40 in the image forming apparatus, and the door 80 of the image forming apparatus is closed.

Referring to FIG. 7, the main assembly frame 300 of the image forming apparatus is provided with a fixation unit supporting member 301 and a fixation unit holding mechanism 310. The fixation unit supporting member 301 supports the fixation unit 40 by the bottom surface of the fixation unit 40 against the weight of the fixation unit 40. The fixation unit holding mechanism 310 keeps the fixation unit 40 properly positioned by properly positioning the lengthwise ends of the fixation unit 40.

Referring to FIG. 3, the fixation unit 40 is provided with a downstream locking lever 400 and a downstream locking spring 401, which are on the downstream side of the nip N of the fixation unit 40. The downstream locking lever 400 locks the exit guide 105 so that the exit guide 105 cannot be moved. The downstream lock spring 401 provides the downstream locking lever 400 with the force which keeps the locking lever 400 in the locking position. The downstream locking lever 400 and downstream lock spring 401 are outside the recording medium passage. The downstream locking lever 400 is held by the fixation unit frame 130 so that it can be pivotally moved about its pivot 400*a*. It is held by the resiliency of the downstream locking spring 401, being kept in a preset position by the stopper portion 130*a* of the fixation unit frame 130.

The main assembly frame 300 of the image forming apparatus is provided with a downstream locking lever disengaging lever 402 for disengaging the above described downstream locking lever 400. The downstream locking lever disengaging lever 402 is in the form of a protrusion, and protrudes from the main assembly of the image forming apparatus in the direction in which the fixation unit 40 is inserted into, or extracted from, the main assembly. It is positioned so that when the fixation unit 40 is in its image forming position in the image forming apparatus, it remains in contact with the downstream locking lever 400.

Next, referring to FIG. 7, the state in which the fixation unit 40 is during image formation is described.

During an image forming operation, the fixation unit 40 is in the main assembly of the image forming apparatus, and the door 80 is shut against the main assembly. Further, the upstream recording medium conveyance passage 30 is in the preset position.

Further, the fixation unit 40 remains immovably held to the main assembly frame 300 by the fixation unit holding mechanism 310. The end portions 400*b* of the downstream locking lever 400, which are protruding from the fixation unit frame 130, remain under the pressure applied by the downstream locking lever disengaging lever 402. Thus, the downstream locking lever 400 is in the position into which it has been pivotally moved in the clockwise direction of FIG. 7, against the resiliency of the downstream lock spring 401, because the lengthwise end portions 400*b* are under the pressure applied by the downstream locking lever disengaging lever 402. When the fixation unit 40 is in this state, the locking surface 400*c*, which belongs to the end portion of the downstream locking member, which is on the exit guide 105 side, is in the position into which it has been retracted, and in which it does not make contact with the exit guide 105. Therefore, the exit guide 105 does not interfere with the movement of the exit guide 105.

Figure 8:
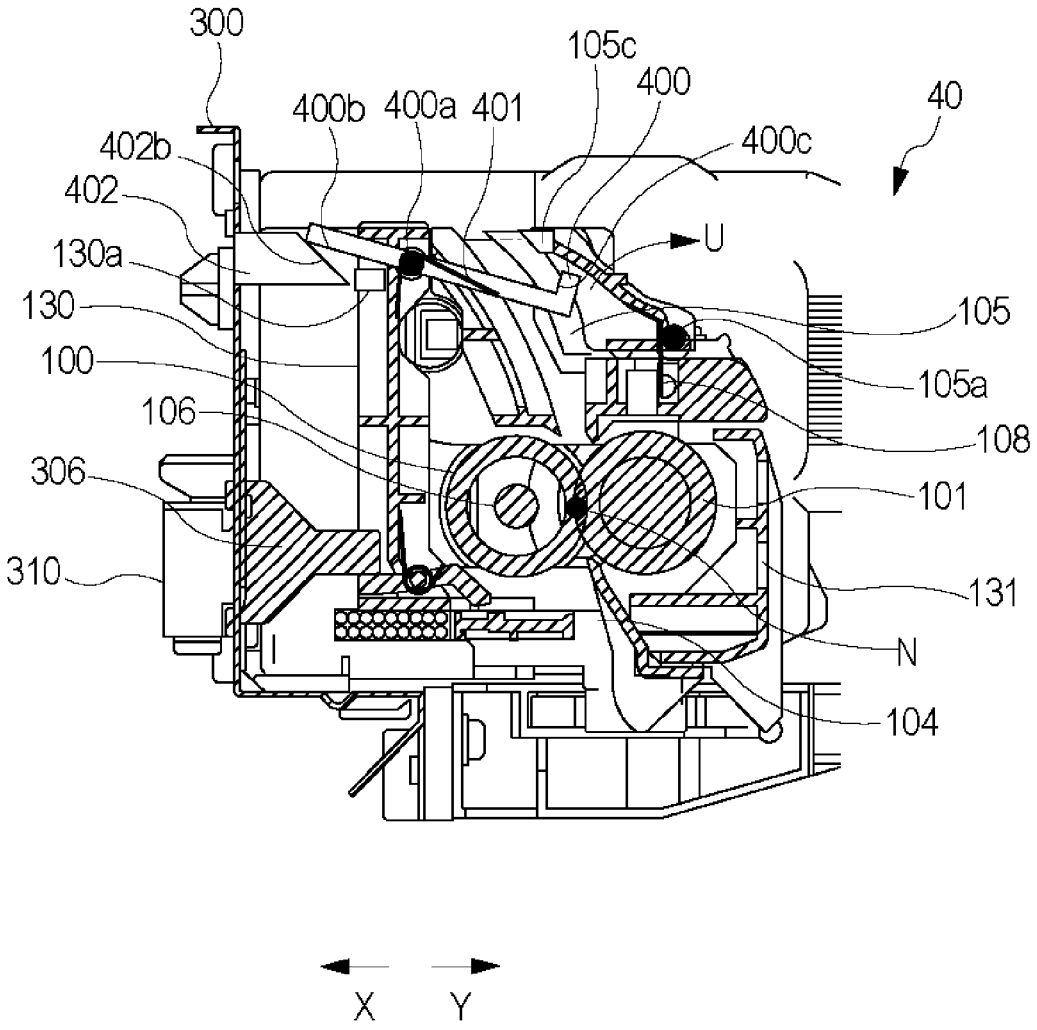
FIG. 8 is a drawing for illustrating the state in which the fixation unit in the second embodiment is when the fixation unit is in the image forming apparatus and the door of the image forming apparatus is open.

Next, referring to FIG. 8, what occurs as the door 80, which is in the above described position, is opened is described.

When the door 80 is opened, the downstream locking lever 400 is not moved by the movement of the door 80. Therefore, the downstream locking lever 400 remains in the position in which it does not contact the exit guide 105, leaving thereby the exit guide 105 unlocked. Therefore, the exit guide 105 is pivotally movable about the hinge 105*a* in the direction U in the drawing.

As the door 80 is opened in the direction Y when the fixation unit 40 is in its image heating position, it becomes possible for the fixation unit 40 to be moved out of the apparatus main assembly. It is assumed here that the jam has occurred to the fixation unit 40, and a sheet P of the recording medium is protruding from the fixation unit 40 through the downstream opening of the fixation unit 40. In such a case, an operator is likely to put his or her fingers through the gap between the image forming apparatus and fixation unit 40, in the direction indicated by an arrow mark X, and try to pull the sheet P out of the fixation unit 40 in the direction Y by grasping the portion of the sheet P, which is protruding through the downstream opening.

In the above-described situation, the sheet P, which is being pulled in the direction Y, comes into contact with the exit guide 105, and presses the exit guide 105 in the direction Y. Here, the exit guide 105 is remaining unlocked as described above. Therefore, as it is pressed by the sheet P, it pivotally moves against the resiliency of the exit guide spring 108, in the clockwise direction indicated by an arrow mark U.

Therefore, as the sheet P is pulled, the downstream opening widens. Therefore, such a situation that the sheet P is caught by the exit guide 105, being thereby prevented from being moved out of the fixation unit 40 can be avoided. That is, it becomes easier to pull the sheet P out of the fixation unit 40 in the direction indicated by the arrow mark Y in the drawing.

Figure 9:
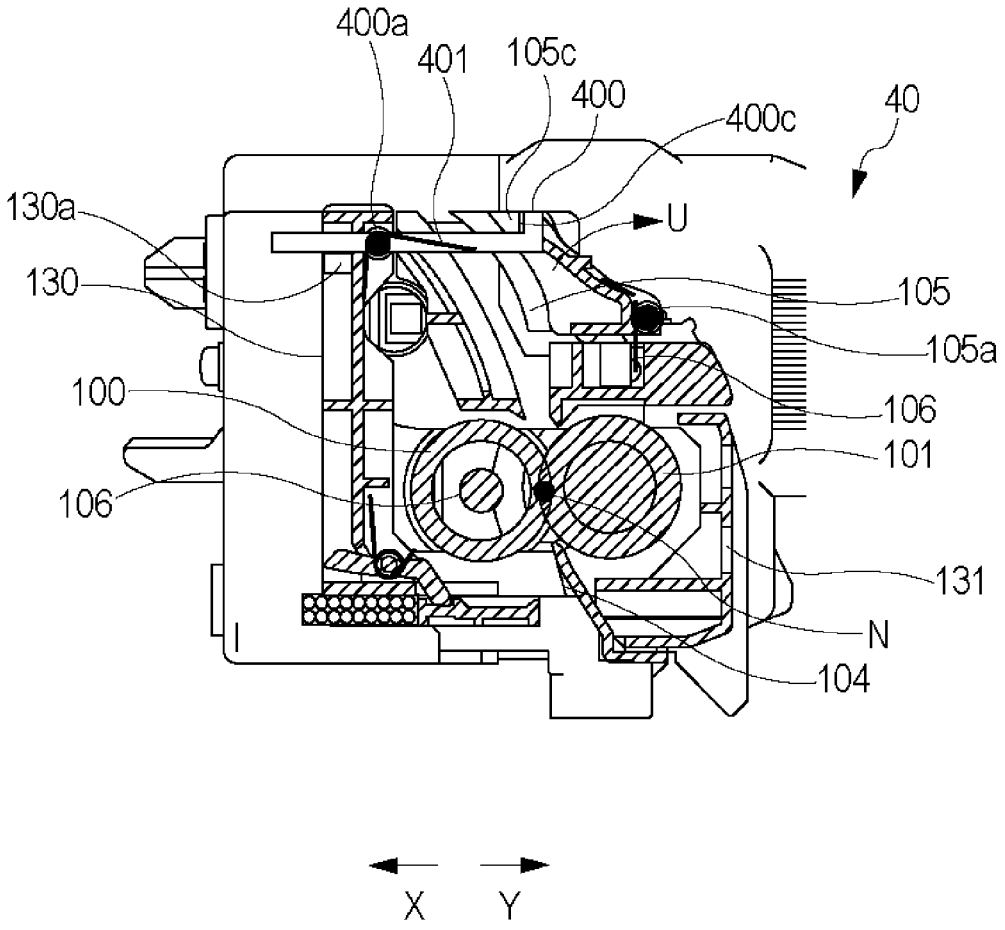
FIG. 9 is a drawing for illustrating the state in which the fixation unit in the second embodiment is when the fixation unit is out of the image forming apparatus.

Next, referring to FIGS. 8 and 9, the operation for inserting the fixation unit 40 into the image forming apparatus, and the operation for extracting the fixation unit 40 from the main assembly of the image forming apparatus, are described. FIG. 8 is a drawing for illustrating the state in which the fixation unit 40 in this embodiment is after the installation of the fixation unit 40 into the image forming apparatus and before the closing of the door 80. FIG. 9 is a drawing for illustrating the state in which the fixation unit 40 in the second embodiment is when the fixation unit 40 is out of the image forming apparatus.

During an operation for removing the fixation unit 40 from the main assembly frame 300, the state of the fixation unit 40 changes from the one shown in FIG. 8 to the one shown in FIG. 9. As the fixation unit 40 in the image forming apparatus is moved in the direction Y, the downstream locking lever 400 with which the fixation unit 40 is provided separates from the downstream locking lever disengaging lever 402.

As the downstream locking lever 400 separates from the downstream locking lever disengaging lever 402, it is pivotally moved about the pivot 400*a* in the counterclockwise direction of the drawing by the resiliency of the downstream locking spring 401. Thus, the locking surface 400*d* of the downstream locking lever 400 comes into contact with the locking surface 105*c* of the exit guide 105, preventing thereby the exit guide 105 from moving in the direction U. That is, the exit guide 105 is locked in position by the downstream locking lever 400. Therefore, it does not occur that when the fixation unit 40 is out of the main assembly of the image forming apparatus, the exit guide 105 is pushed open by an operator. Therefore, it does not occur that when the fixation unit 40 is out of the main assembly of the image forming apparatus, a finger of an operator accidentally enters the fixation unit 40 through the downstream opening.

During an operation for installing the fixing unit 40 into the main assembly frame 300, the state of the fixation unit 40 changes from the one shown in FIG. 9 to the one in FIG. 8. As the fixation unit 40 is inserted into the main assembly of the image forming apparatus in the direction X, the downstream locking lever 400 comes into contact with the downstream locking lever disengaging lever 402. More concretely, the lever contacting portion 402*b* of the downstream locking lever disengaging member 402 comes into contact with the locking lever disengaging member contacting portion 40*b* of the downstream locking lever 400, and presses the downstream locking lever 400 against the resiliency of the downstream lock spring 401.

Thus, the downstream locking lever 400 is pivotally moved about the pivot 400*a* in the clockwise direction of the drawing, into the preset position, in which the locking surface 400*c* of the downstream locking lever 400 does not make contact with the locking surface 105*c* of the exit guide 105. Then, the downstream locking lever 400 is retained in this position, in which it does not lock the exit guide 105 in position.

According to this embodiment, there is little possibility that when the fixation unit 40 is out of the main assembly of the image forming apparatus, a finger of an operator will come into contact with the internal components of the fixation unit 40.

Further, according to this embodiment, there is little concern that when the fixation unit 40 is out of the main assembly of the image forming apparatus, a finger of an infant touches the internal component of the fixation unit 40.

Further, according to this embodiment, it does not occur that when the fixation unit is out of the main assembly of an image forming apparatus, the exit guide located next to the opening is pushed open by an operator.

Further, according to this embodiment, a sheet of the recording medium can be removed from the fixation unit 40 when the fixation unit 40 is out of the main assembly of the image forming apparatus.

Further, according to this embodiment, a sheet of the recording medium can be removed from the fixation unit 40 when the fixation unit 40 is in the main assembly of the image forming apparatus.

Further, according to this embodiment, it is on the recording medium exit side of the fixation unit 40 that above described effects can be obtained.

Further, effects such as those obtained by the fixation units 40 in the first and second embodiments can be obtained even if the fixation unit 40 is structured as follows.

That is, application of the present invention is not limited to a fixation unit which is removably installable in an image forming apparatus, and which is used as the image fixing portion of the image forming apparatus. For example, the present invention is also applicable to an image heating unit which applies heat and pressure to a sheet of the recording medium, on which a fixed image, or an incompletely fixed image, is present, to modify the image in surface properties. Further, the present invention is applicable to a recording medium conveying unit made up of a pair of rotational components, such as a pair of registration rollers 9 of the secondary transferring portion 3 and a pair of recording medium conveyance rollers of the recording medium conveying portion 13.

In the first and second embodiments, the pair of rotational members of the fixation unit 40 were the heat roller (fixation roller 100) and contact roller 101. However, the present invention is also applicable to a fixation unit having a heating belt and a contact belt, in place of the heat roller and contact roller, respectively.

Further, in the first and second embodiments, the heat source disposed in the hollow of the heat roller was used to heat the heat roller. However, the present invention is also applicable to a fixation unit which electromagnetically heats its heat roller with the use of excitation coil or the like.

Further, in the first and second embodiments, the image forming apparatus was structured so that as the fixation unit 40 is inserted into, or pulled out of, the main assembly of the image forming apparatus, the movable member is locked or unlocked. However, the present invention is also applicable to an image forming apparatus, the movable member of which is locked or unlocked by the movement (opening or closing) of the door. More concretely, the door is provided with a protrusion for disengaging the upstream locking lever, so that as the door is closed, the protrusion presses the upstream locking lever to disengage the lever. In the case of this structural arrangement, it is unnecessary to provide the main assembly of the image forming apparatus with a locking mechanism (engaging mechanism) for locking the sliding cover 200 when the fixation unit 40 is in the main assembly, but the door is open.

Further, image forming apparatuses which employ an image heating unit, and to which the present invention is applicable, are not limited to image forming apparatuses for forming full-color images. That is, the present invention is also applicable to monochromatic image forming apparatuses. Further, image forming apparatuses to which the present invention is applicable are not limited to printers. That is, the present invention is also applicable to copying machines, facsimile machines, and multifunction image forming apparatuses capable of performing two or more functions of the preceding image forming apparatuses.

Embodiment 3

Next, the third embodiment of the present invention is described. By the way, this embodiment is described with reference to a full-color printer of the so-called tandem type, which is an example of various image forming apparatuses. In FIGS. 10-18, which illustrate the third embodiment, the reference numerals used include and are between 1001 and 1094. However, for the sake of simplicity of exposition, in the discussion of third embodiment below, the elements illustrated in FIGS. 10-18 are referred to by i) their last two numerical digits or their last digit if the second-from-the-right digit is a 0, and ii) any letters positioned after these last two digits, and iii) ignoring the first two digits. As a result, when reference numeral "1" is referred to below, the corresponding element in FIGS. 10-18 is the element 1001. Similarly, when reference numeral "10" is referred to below, the corresponding element in FIGS. 10-18 is the element 1010, when reference numeral "20" is referred to below, the corresponding element in FIGS. 10-18 is the element 1020, when reference numeral "31*y*" is referred to below, the corresponding element in FIGS. 10-18 is the element 1031*y*, etc.

Figure 10:
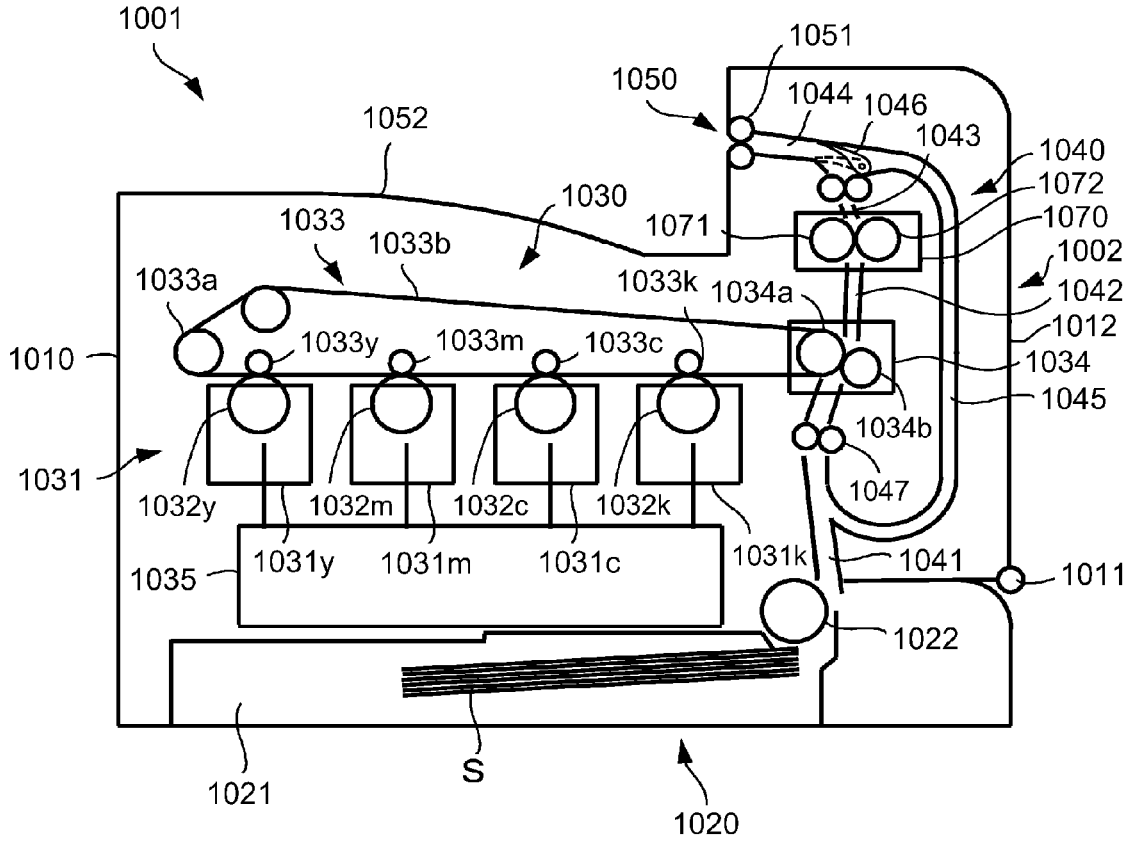
FIG. 10(*a*) is a sectional view of the image forming apparatus in the third embodiment of the present invention, and shows the general structure of the apparatus.
Figure 10:
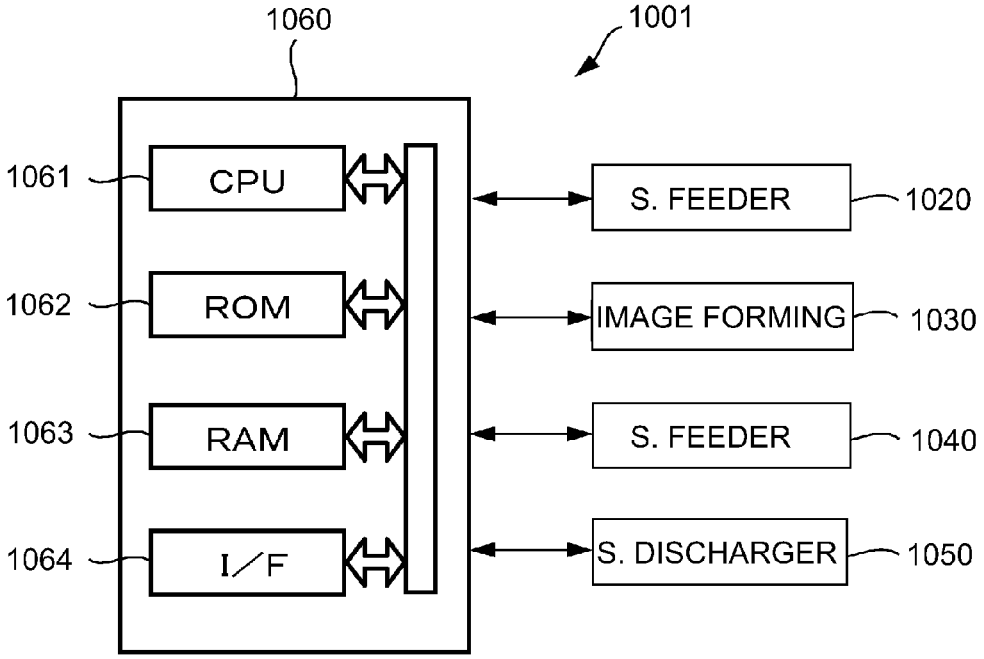

Referring to FIG. 10, the image forming apparatus 1 has a main assembly 10 (which hereafter will be referred to as apparatus main assembly). The apparatus main assembly 10 has a sheet feeding/conveying section 20, an image forming means 30, a sheet conveying section 40, a sheet discharging section 50, and a control section 60. Incidentally, a sheet S is a sheet of the recording medium across which an image is formed. For example, it may be a sheet of ordinary paper, a sheet of resinous substance (which may be used in place of ordinary paper), a sheet of cardstock, a sheet of film for an overhead projector, etc.

The sheet feeding/conveying section 20 is in the bottom portion of the apparatus main assembly 10. It has a sheet cassette 21 in which sheets S of the recording paper or the like are stored in layers, and a feed roller 22. It is structured to feed sheets of the recording medium into the apparatus main assembly 10, and convey them to the image forming means 30.

The image forming means 30 has an image forming section 31, a laser scanner 35, an intermediary transfer unit 33, a secondary transferring section 34, and a fixing device 70 as an example of unitized section. It forms images.

The image forming section 31 has four image formation units 31*y*, 31*m*, 31*c* and 31*k* for forming four toner images, different in color, one for one, more specifically, yellow (y), magenta (m), cyan (c) and black (b) monochromatic toner images, respectively. The four image formation units can be individually installed into, or removed from, the apparatus main assembly 10 by a user. For example, the image formation unit 31*y* has: a photosensitive drum 32*y* which is an image bearing member on which a toner image is formed; an unshown charge roller; a development roller; a drum cleaning blade; toner; etc. By the way, the other image formation units 31*m*, 31*c*, and 31*k* are the same in structure as the image formation unit 31*y*, and therefore, will not be described in detail.

The laser scanner 35 is an exposing means which exposes the peripheral surface of the photosensitive drums 32*y*, 32*m*, 32*c* and 32*k* to form an electrostatic latent image on the peripheral surface of the photosensitive drums 32*y*, 32*m*, 32*c* and 32*k*.

The intermediary transferring unit 33 is above the combination of the image formation units 31*y*, 31*m*, 31*c* and 31*k*. It has: multiple rollers, more specifically, a driving roller 33*a*, and four primary transfer roller 33*y*, 33*m*, 33*c* and 33*k*, etc.; and an intermediary transfer belt 33*b* suspended by these rollers in a manner to envelop the rollers. The primary transfer rollers 33*y*, 33*m*, 33*c* and 33*k* are disposed so that they oppose the photosensitive drums 32*y*, 32*m*, 32*c* and 32*k*, respectively. They are in contact with the intermediary transfer belt 33*b*. As positive transfer bias is applied to the intermediary transfer belt 33*b* by the primary transfer rollers 33*y*, 33*m*, 33*c* and 33*k*, the toner images on the photosensitive drums 32*y*, 32*m*, 32*c* and 32*k*, which are negative in polarity, are sequentially transferred in layers onto the intermediary transfer belt 32*b*. As a result, a full-color image is effected on the intermediary transfer belt 33*b*.

The secondary transferring section 34 has a secondary transfer internal roller 34*a*, and a secondary transfer external roller 34*b*. As positive secondary transfer bias is applied to the secondary transfer external roller 34*b*, the full-color image on the intermediary transfer belt 32*b* is transferred onto a sheet S. Incidentally, the secondary transfer internal roller 34*a* supports the intermediary transfer belt 33*b* from within the loop which the intermediary transfer belt 33*b* forms. It is disposed so that it opposes the secondary transfer external roller 34*b* with the presence of the intermediary transfer belt 33*b* between the two rollers 34*a* and 34*b*.

The fixing device 70 has a fixation roller 71 (heating roller) and a pressure roller 72 as its primary components. It is structured so that as a sheet S is conveyed through it, remaining pinched between the fixation roller 71 and pressure roller 72, the toner image transferred onto the sheet S is subjected to heat and pressure, whereby the toner image is fixed to the sheet S. That is, the fixation roller 71 and pressure roller 72 are in the apparatus main assembly 10, and make up parts of the image forming means. The detailed structure of the fixing device 70 is described later.

The sheet conveying section 40 has: a recording medium conveyance passage 41, which is on the immediately upstream side of the secondary transferring section 34; a recording medium conveyance passage 42, which is on the immediately upstream side of the fixing device 70; a recording medium conveyance passage 43 which is on the immediately downstream side of the fixing device 70; a recording medium discharge passage 44; and a recording medium re-conveyance passage 45. The sheet conveying section 40 is structured so that as a sheet S is fed into the apparatus main assembly 10 from the sheet feeding/conveying section 20, the sheet conveying section 40 conveys the sheet S to the image forming means 30, and then, to the sheet discharging section 50.

The image forming apparatus is structured so that as a sheet S is fed into the apparatus main assembly 10, the sheet S is conveyed to the secondary transferring section 34 through the recording medium conveyance passage 41. The recording medium conveyance passage 41 is provided with a pair of registration rollers 47, which catch the sheet S and temporarily hold the sheet S to correct the sheet S in attitude if the sheet S happens to be slanted relative to the recording medium conveyance direction. The recording medium conveyance passage 42, which is on the immediately upstream side of the fixing device 70 catches the sheet S as the sheet S comes out of the secondary transferring section 34, and guides the sheet S from the secondary transferring section 34 to the fixing device 70. The recording medium conveyance passage 43 catches the sheet S as the sheet S comes out of the fixing device 70, and then, guides the sheet S from the fixing device 70 to the flapper 46.

The sheet discharge passage 44 catches the sheet S as the sheet S passes by the flapper 46, and then, guides the sheet S from the flapper 46 to the sheet discharging section 50. The re-conveyance passage 45 is for reversing the sheet S in the conveyance direction with the utilization of the sheet discharge passage 44 after the formation of an image on one of the two surfaces of the sheet S, and then, conveying the sheet S to the image forming means 30 to form an image on the other surface of the sheet S.

The sheet discharging section 50 has: a pair of discharge rollers 51, which are at the downstream end of the sheet discharge passage 44; and a face-down delivery tray 52, which is on the immediately downstream side of the pair of discharge rollers 51. As the sheet S is delivered to the pair of discharge rollers 51 through the sheet discharge passage 44, the discharge rollers 55 discharge the sheet S into the face-down delivery tray 52.

Referring to FIG. 10(*b*), the control section 60 is made of a computer, which comprises: a CPU 61; a ROM which stores programs for controlling various sections of the image forming apparatus; a RAM 63 which temporarily stores data; and an input/output circuit (I/F) 64 which exchanges signals with external devices. The control section 60 is in connection to the sheet feeding/conveying section 20, image forming means 30, sheet conveying section 40, and sheet discharging section 50, through the input/output circuit 64. It exchanges signals with these sections, and also, controls their operations.

Next, referring to FIG. 10(*a*), the image forming apparatus 1 structured as described above is described about its image forming operation and recording medium conveying operation.

As an image forming operation is started, first, the laser scanner 35 begins to scan the peripheral surface of each of the photosensitive drums 32*y*, 32*m*, 32*c* and 32*k*, with the beam of laser light it emits while modulating the beam according to the image formation information transmitted thereto from an unshown personal computer or the like. The peripheral surface of each of the photosensitive drums 32*y*, 32*m*, 32*c* and 23*k* has been uniformly charged to preset polarity and potential level. Thus, as a given point of the uniformly charged portion of the peripheral surface of each photosensitive drum 32 is exposed to the beam of laser light, it reduces in the amount of electric charge. Consequently, an electrostatic latent image is effected on the peripheral surface of each photosensitive drum 32. This electrostatic latent image is developed by the yellow, magenta, cyan, or black toner, supplied to the peripheral surface by the development roller, into a visible image, that is, a toner image (image formed of toner).

The monochromatic toner images, different in color, are sequentially transferred in layers onto the intermediary transfer belt 33*b* by the primary transfer bias applied to each of the primary transfer rollers 33*y*, 33*m*, 33*c* and 33*k*. Consequently, a full-color toner image is effected on the surface of the intermediary transfer belt 33*b*.

While the monochromatic toner images, different in color, are formed, the multiple sheets S stored in the sheet cassette 21 are separated one by one, and fed into the apparatus main assembly 10. Then, the pair of registration rollers 47 are driven with such timing that each sheet S coincides in position with the full-color toner image on the intermediary transfer belt 33*b*, in the secondary transferring section 34. Thus, the sheet S is conveyed to the secondary transferring section 34, in which the four monochromatic toner images, different in color, of which the full-color toner image is formed on the intermediary transfer belt 33*b*, are transferred together onto the sheet S, by the secondary transfer bias applied to the external roller 34*b*, in the secondary transferring section 34.

After the full-color toner image is transferred onto the sheet S, the sheet S is conveyed to the fixing device 70, in which the full-color toner image is subjected to heat and pressure. Therefore, the four toners, different in color, of which the full-color image is formed, melt and mix, and then, become fixed to the sheet S. That is, the full-color toner image is fixed to the sheet S. Thereafter, the sheet S having the fixed toner image is discharged by the sheet discharging section 50 which is on the downstream side of the fixing device 70.

The apparatus main assembly 10 has an external cover 12 and a hinge 11. The external cover 12 covers the sheet conveyance passage 40 side of the apparatus main assembly 10, and is pivotally movable about the hinge 11 to be opened or closed. The external cover 12 is provided with a pair of walls, which oppose each other, and form the re-conveyance passage 45 between them. Further, the external cover 12 has: a pre-secondary-transfer recording medium conveyance passage 41, a pre-fixation recording medium conveyance passage 42, a post-fixation recording medium conveyance passage 43, and a recording medium discharge passage 44, which are in one (right one in FIG. 10) of the two walls.

As the external cover 12 is opened, the recording medium conveying section 40 is exposed, from its pre-secondary-transfer recording medium conveyance passage 41 to its pair of discharge roller 51, except for the recording medium passage in the fixing device 70. Thus, opening the external cover 12 makes it possible to perform maintenance operations, such as removing a sheet S stuck in the recording medium conveying section 40.

Next, referring to FIGS. 11-18, the fixing device 70 is described in detail.

Figure 11:
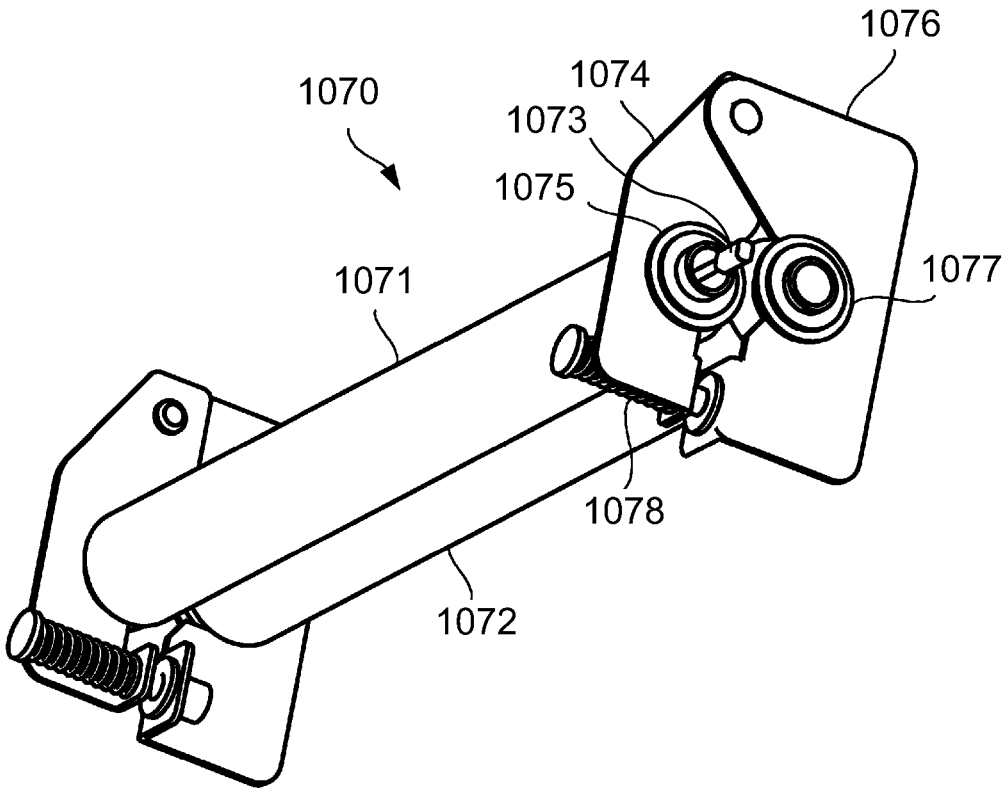
FIG. 11 is a perspective view of the main section of the fixing device of the image forming apparatus in the third embodiment.

Referring to FIG. 11, the fixing device 70 has a pair of rollers, more specifically, the fixation roller 71 and the pressure roller 72, which are for applying heat and pressure to the toner image on the sheet S to fix the toner image to the sheet S. The fixation roller 71 is a cylindrical hollow member. Its surface layer is a parting layer which is low in coefficient of friction. There is a halogen heater in the hollow of the fixation roller 71, to heat the fixation roller 71. The fixation roller 71 is supported by a pair of pressure application lever 74, with the placement of a pair of fixation roller bearings 75 between the pressure application levers 74 and the fixation roller 71. The pressure roller 72 is supported by a pair of supporting members 76 with the placement of a pair of pressure roller bearings 77 between the pressure roller 72 and the supporting members 76. The pressure application lever 74 and the supporting member 76 are in connection to each other, and are pivotally movable relative to each other about their points of connection. The fixing device 70 is provided a pair of springs 78, which generate pressure in such a direction that reduces the gap between the pressure application lever 74 and the pressure roller 72. That is, the fixation roller 71 and the pressure roller 72 are under the pressure generated by the springs 78.

Figure 12:
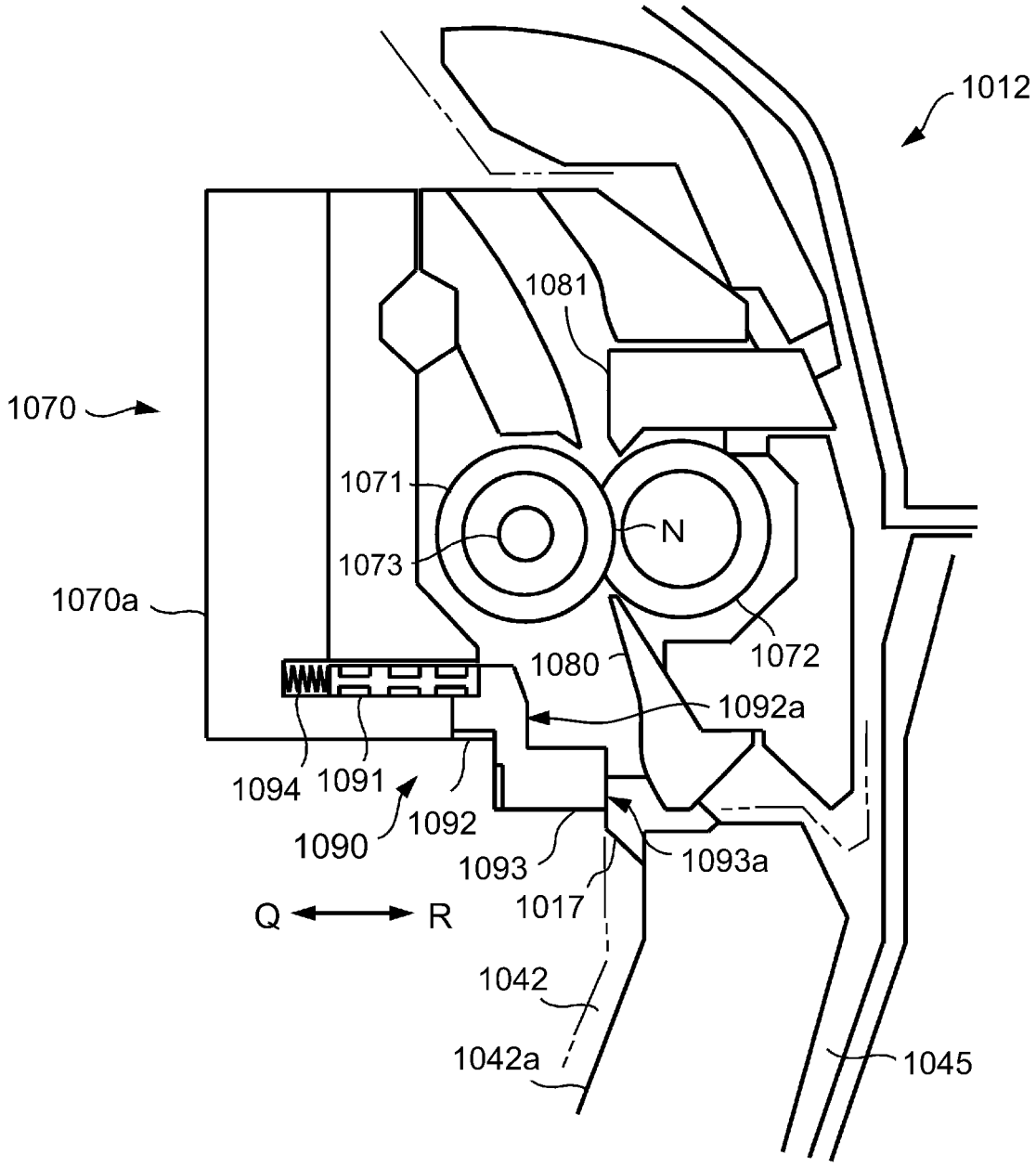
FIG. 12 is a schematic sectional view of the fixing device of the image forming apparatus in the third embodiment, when the fixing device is in the image forming apparatus, and, and shows the general structure of the fixing device.
Figure 13:
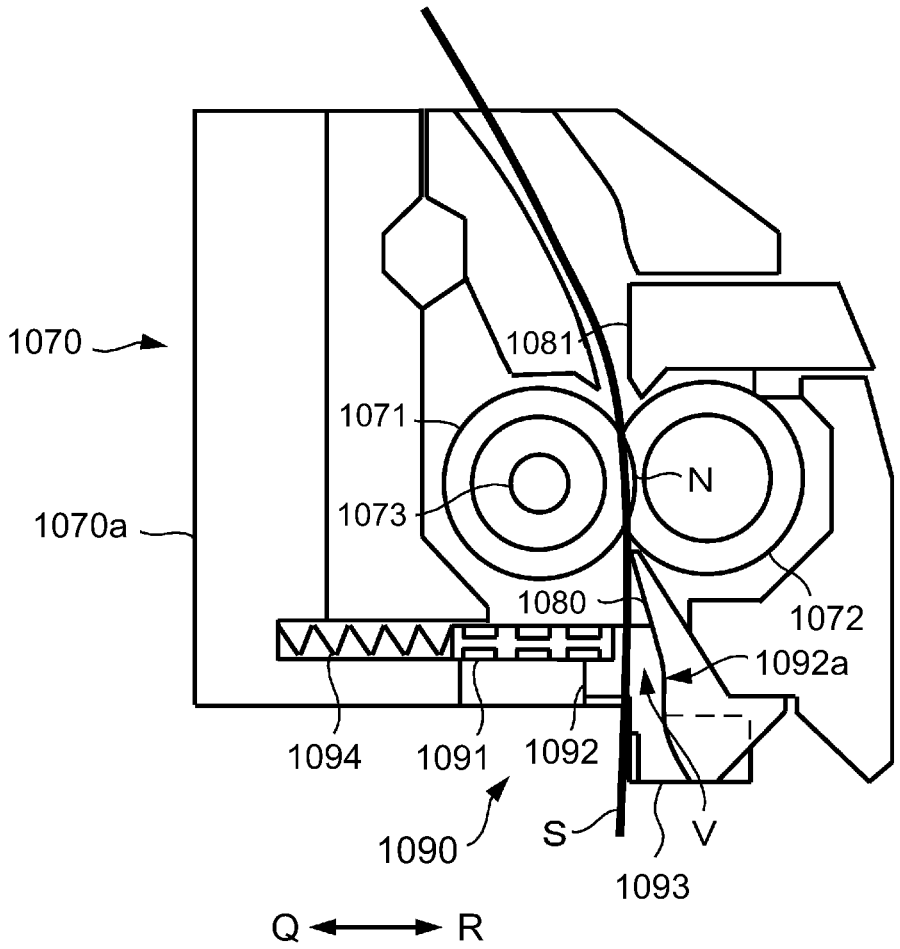
FIG. 13 is a schematic sectional view of the fixing device of the image forming apparatus in the third embodiment, when the fixing device is out of the image forming apparatus, and shows the general structure of the fixing device.

Next, referring to FIGS. 12 and 13, there is a nip N (area of contact) between the peripheral surface of the fixation roller 71 and the peripheral surface of the pressure roller 72. Further, there is provided an entrance guide 80 on the upstream side of the nip N. The upstream side of the pressure roller 72 is covered with the entrance guide 80. There is provided an exit guide 81 on the downstream side of the nip N. The entrance guide 80 and the exit guide 81 assist (support) a sheet S as the sheet S is conveyed through the fixing device 70. The fixing device 70 is structured so that the fixation roller 71 and the pressure roller 72 are rotationally driven by a driving mechanism (unshown) to convey a sheet S between the fixation roller 71 and the pressure roller 72 to apply heat and pressure to the unfixed toner image on the sheet S to fix the toner image, and then, the sheet P is conveyed further downstream.

Referring to FIG. 12, the right-hand side of the double-dot chain line shows the components attached to the external cover 12. Thus, as the external cover 12 is opened, the components on the right-hand side of the double-dot chain line are moved away from the apparatus main assembly 10. Consequently, the fixing device 70 is exposed as shown in FIG. 13. Incidentally, FIG. 13 does not show the component of the apparatus main assembly 10, which supports the fixing device 70.

On the upstream side of the nip N, there is a sliding cover 90, as a fixing device entrance cover, which is on the opposite side of the exit guide 80. Referring to FIGS. 12-15, the sliding cover 90 has: a main section 91, the lengthwise direction of which coincides with the widthwise direction of the sheet S which is being conveyed through the nip N; a pair of support portions 92 which are at the lengthwise ends of the main section 91, one for one; a pair of contact portions 93 which protrude from the support portion 92, one for one, toward the entrance guide 80. The support portion 92 is supported by the main section of the casing of the fixing device 70, being enabled to linearly move in the direction which is roughly perpendicular to the recording medium conveyance direction (indicated by arrow marks Q and R in FIGS. 12 and 13). That is, the sliding cover 90 is slidable in the same direction as the direction in which the external cover 12 is movable.

As the support portion 92 is slid relative to the main section 70*a* of the fixing device casing, the entirety of the sliding cover 90 is slid relative to the main section 70*a*, and the main section 91 of the sliding cover 90 covers the fixation roller 71, and the upstream side of the nip N. That is, the sliding cover 90 is enabled to move between its open position in which it exposes the fixation roller 71 and the upstream side of the nip N as shown in FIG. 12, and its closed position in which it covers the fixation roller 71 and the upstream side of the nip N as shown in FIG. 13, to take one of the two positions.

The support section 92 is under the pressure generated in the direction to press the support section 92 toward the entrance guide 80, by a spring 94, as the first pressure applying means, which is a compression spring attached to the main section 70*a* of the fixing device casing. That is, the spring 94 continuously pushes the sliding cover 90 toward the closed position. Therefore, when the fixing device 70 is out of the apparatus main assembly 10, the sliding cover 90 is kept by the spring 94 in the state in which the end surface 92*a* of the support section 92 is in contact with the entrance guide 80, at both of the lengthwise ends of the entrance guide 80, as shown in FIG. 13. That is, when the fixing device 70 is out of the apparatus main assembly 10, the main section 91 of the sliding cover 90 keeps the fixation roller 71 and the upstream side of the nip N covered, preventing thereby a finger, or the like, of a user, from coming into contact with the fixation roller 71 and nip N, from the upstream side of the nip N.

Further, the fixing device 70 is structured so that even when the end surface 92*a* of the support section 92 is in contact with the entrance guide 80, there remains a small gap V, as a sheet passage, between the entrance guide 80 and the main section 91 of the sliding cover 90. Therefore, even if the sliding cover 90 is closed by the opening of the external cover 12, there is always the small gap V. Therefore, even if a paper jam occurs and stops recording medium conveyance when a sheet S is between the fixation roller 71 and the pressure roller 72, it is possible to extract the sheet P between the fixation roller 71 and the pressure roller 72 through the gap V by opening the external cover 12.

By the way, the portion of the recording medium conveying section, which is on the downstream side of the fixation roller 71 and nip N, is long and narrow. Therefore, even if there is nothing to cover the recording medium conveying section, a finger of a user, or the like, is prevented from touching the fixation roller 71 and nip N, from the downstream side of the fixing device 70.

Figure 14:
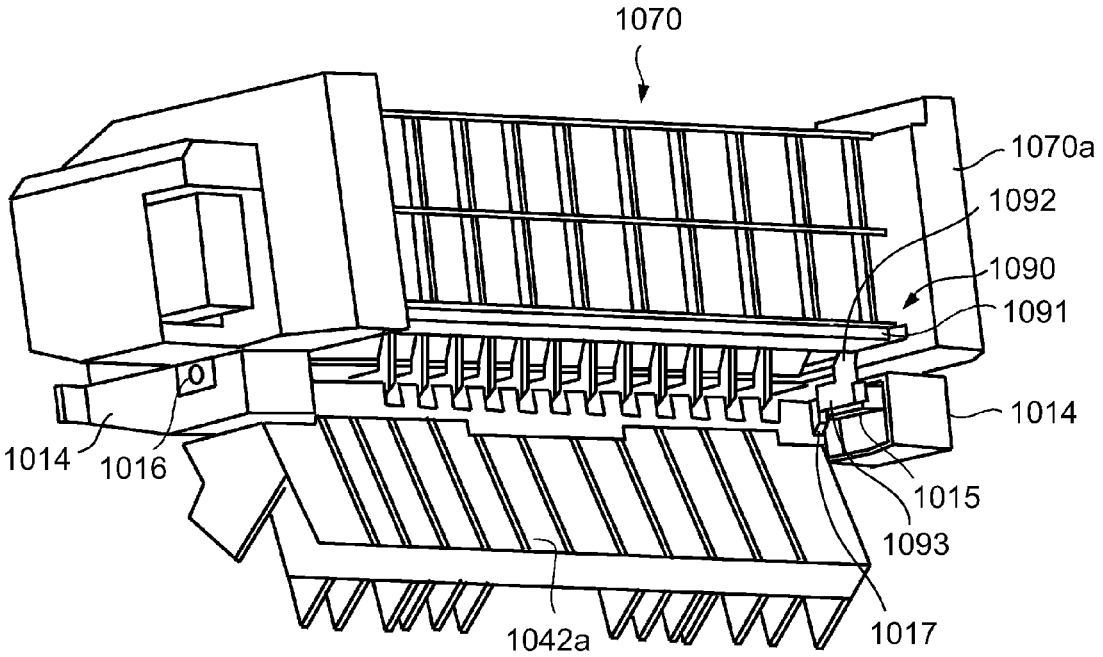
FIG. 14 is a perspective view of the fixing device of the image forming apparatus in the third embodiment, when the fixing device is in the image forming apparatus, and shows the general structure of the fixing device.
Figure 15:
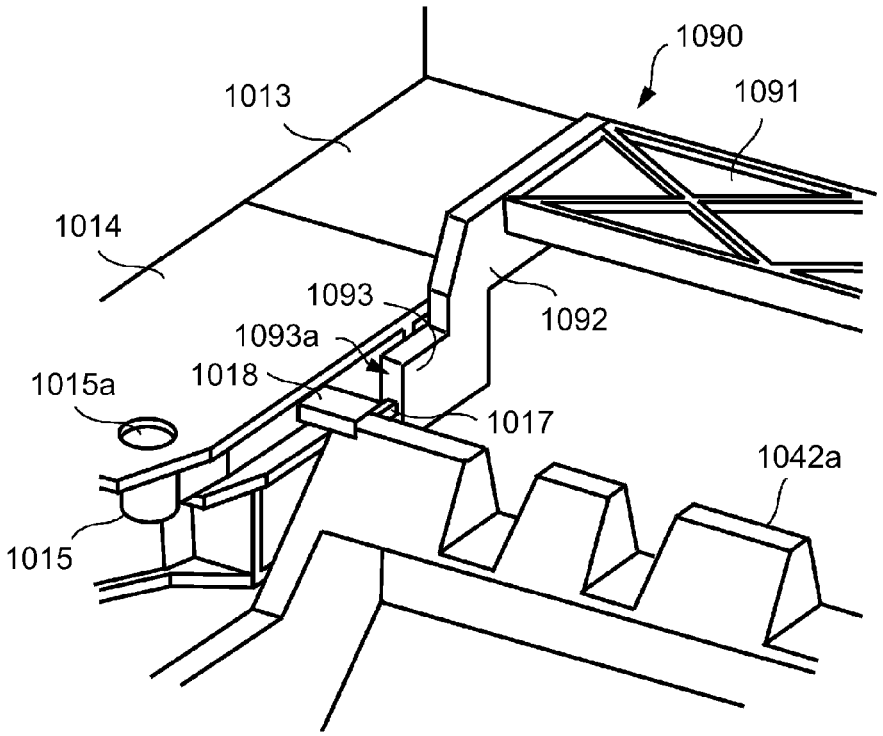
FIG. 15 is a drawing for illustrating the sliding cover of the fixing device, and the locking lever of the image forming apparatus, in the third embodiment.

Next, referring to FIGS. 14 and 15, the structure of the mechanism for locking or unlocking the sliding cover 90 is described.

The main assembly frame 13 of the apparatus main assembly 10 is provided with a pair of fixing devise supporting sections 14 for supporting the fixing device 70. The fixing device supporting sections 14 are located so that they will be in the adjacencies of the lengthwise ends of the fixing device 70 when the fixing device 70 is in the main assembly frame 13. Thus, when the fixing device 70 is in the apparatus main assembly 10, it is on the fixing device supporting section 14, and remains immovably held to the main assembly frame 13 by a combination of a lever (unshown) and a spring (unshown).

The fixing device supporting section 14 has: a locking lever 15 as a locking member for immovably locking the sliding cover 90; and a locking spring 16 as the second pressure generating means for keeping the sliding cover locking lever 15 pressured. The locking lever 15 is supported by the fixing device supporting section 14. It is a pivotally movable lever which is pivotally movable about a pivot 15*a*. It is under the pressure generated by the locking spring 16 in the direction to pivot the locking lever 15 in a preset direction. Further, it is capable of engaging with the sliding cover 90 from the direction perpendicular to the direction in which the sliding cover 90 can be opened or closed.

Figure 16:
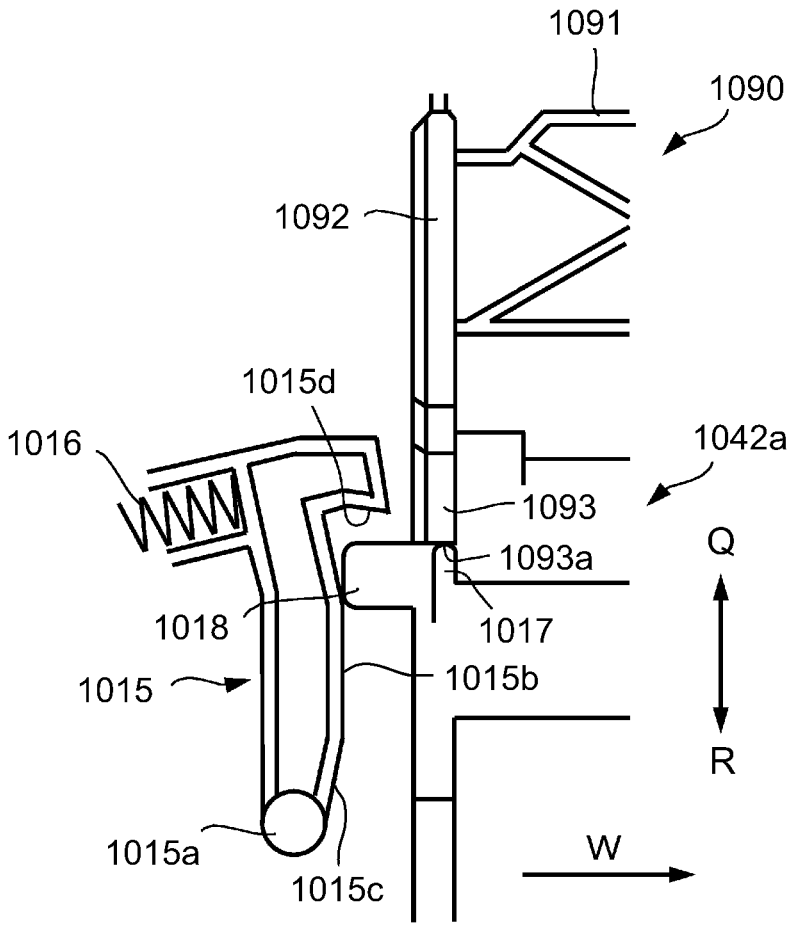
FIG. 16 is a plan view of the sliding cover of the fixing device, and the locking lever of the image forming apparatus, in the third embodiment, after the complete closing of the external cover of the image forming apparatus.
Figure 17:
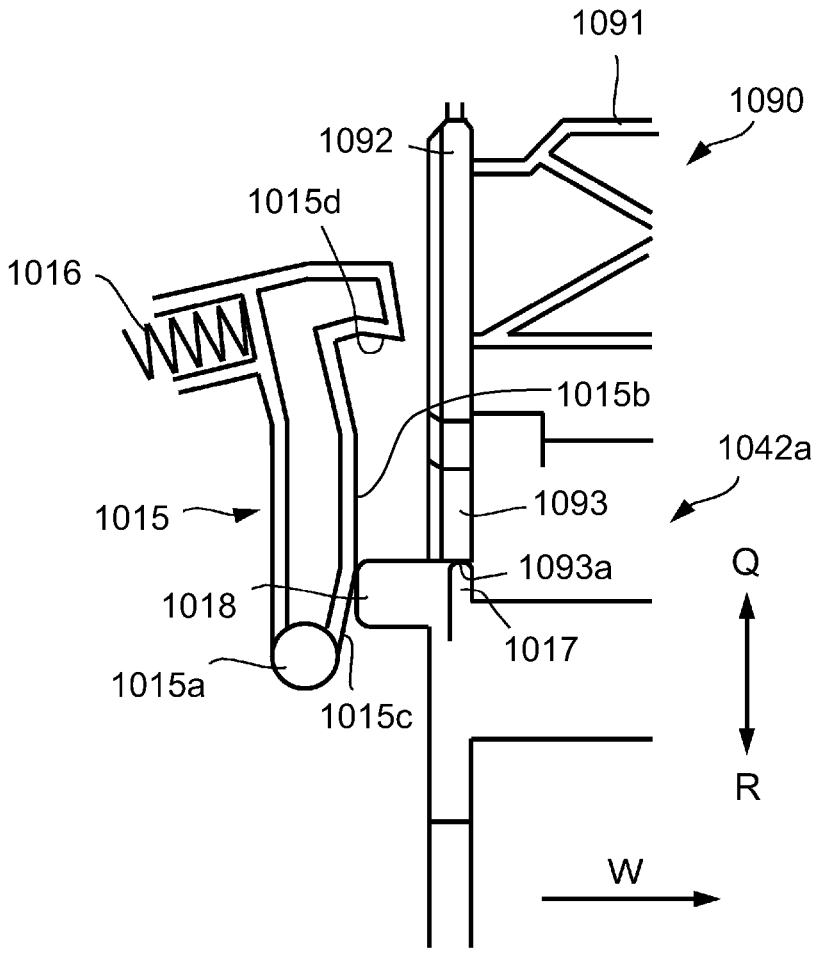
FIG. 17 is a plan view of the sliding cover of the fixing device, and the locking lever of the image forming apparatus, in the third embodiment, when the external cover of the image forming apparatus is slightly open.
Figure 18:
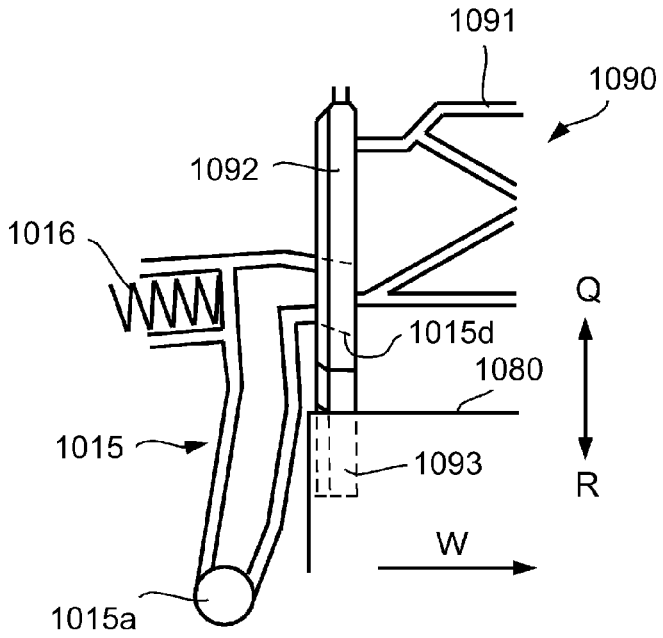
FIG. 18 is a drawing for illustrating the sliding cover of the fixing device and the locking lever of the image forming apparatus, in the third embodiment, FIGS. 18(*a*) and 18(*b*) being top and bottom views, respectively, of the sliding cover and locking lever, when the external cover is open widest.
Figure 18:
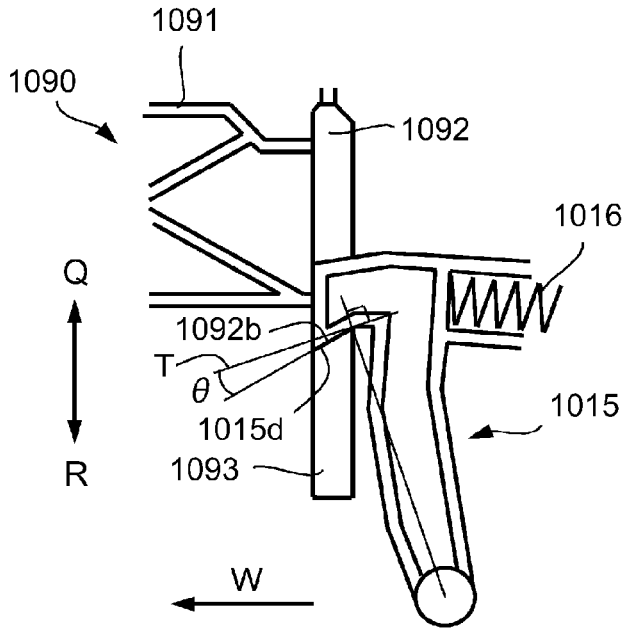

The locking lever 15 can be switched in position between a locking position and an unlocking position. The locking position is the position in which the locking lever 15 remains engaged with the sliding cover 90 when the sliding cover 90 is in its closed position. That is, the locking position is the position in which the locking lever 15 keeps the sliding cover 90 immovably locked in the closed position (FIG. 18). The unlocking position is the position in which the locking lever remains disengaged from the sliding cover 90, and therefore, allows the sliding cover 90 to move (FIGS. 16 and 17). Further, the locking spring 16 is a compression spring, and keeps the locking lever 15 continuously pressured in the direction to move the locking lever 15 from the locking position to the unlocking position.

Further, the locking lever 15 has: a parallel surface (first surface of contact) 15*b* and a slant surface (second surface of contact) 15*c*, which face the second protrusion 18 of the external cover 12. The locking lever 15 is structured so that as it is moved into its unlocking position, its parallel surface 15*b* becomes roughly parallel to the closing direction, indicated by an arrow mark Q, of the external cover 12. The slanted surface 15*c* is angled relative to the parallel surface 15*b*, and extends from the parallel surface 15*b* toward the pivot 51*a*.

Next, referring to FIG. 18, the locking lever 15 has: a locking surface (surface of contact) 15*d*, which engages with the locking surface (surface of contact) 92*b* of the sliding cover 90, which is the downwardly facing surface of the support section 92 of the sliding cover 90, as the locking lever 15 is moved into the locking position. The locking lever 15 and the sliding cover 90 are shaped so that their locking surfaces 15*d* and 92*b*, respectively, can contact with each other with the presence of no gap between them. Further, the angle θ of the locking surface 92*b* of the sliding cover 90, relative to a line T which coincides with the pivot 15*a* of the locking lever 15, and also, the inward edge of the locking surface 92*b* of the sliding cover 90, is accurate and on the opening side (indicated by arrow mark R) of the line T. Therefore, even if a user happens to apply such force that works in the direction (indicated by arrow mark Q) to close the sliding cover 90, with his or her finger, or the like, no moment is generated in the direction to disengage the locking lever 15, and therefore, the sliding cover 90 is not going to open.

The wall 42*a* of the external cover 12, which is a part of the pre-fixation recording medium conveyance passage 42, is provided with first and second protrusions 17 and 18, as parts of linkage, which are located so that they will be in the adjacencies of the fixing device 70 when the fixing device 70 is in the apparatus main assembly 10. The first and second protrusions 17 and 18 are positioned so that as the external cover 12 is opened or closed, the first and second protrusions 17 and 18 come into contact with, or separate from, the sliding cover 90 of the fixing device 70 in the image forming apparatus, and the locking lever 15, to move the sliding cover 90 and locking lever 15.

When the external cover 12 is in its closed position, the first protrusion 17 keeps the sliding cover 90 in the open position against the resiliency of the spring 94, and the second protrusion 18 keeps the locking lever 15 in the position in which the locking lever 15 remains disengaged from the sliding cover 90 against the resiliency of the locking spring 16. On the other hand, when the external cover 12 is open, the first protrusion 17 keeps the sliding cover 90 in the closed position against the resiliency of the spring 94, and the second protrusion 18 keeps the locking lever 15 in the locking position against the resiliency of the locking spring 16.

In this embodiment, the sliding cover 90, the spring 94, the locking lever 15, the locking spring 16, the first protrusion 17, and the second protrusion 18 make up a cover opening/closing device 2. That is, the image forming apparatus 1 has the cover opening/closing device, and the image forming means 30.

Next, referring to FIGS. 12-18, the movement of the sliding cover 90 and locking lever 15 of the image forming apparatus 1 in this embodiment is described in detail.

Referring to FIG. 12, during an image forming operation, the fixing device 70 is in the apparatus main assembly 10, and the external cover 12 remains closed, and therefore, the wall 42*a* of the pre-fixation sheet passage 42 is in its image formation position. Further, the end surface 93*a* of the contact portion 93 of the sliding cover 90 has been moved (pushed) in the closing direction Q by the first protrusion 17, and the main section 91 of the sliding cover 90 is open, as shown in FIG. 12. Further, the sliding cover 90 is kept in contact with the first protrusion 17 by the resiliency of the spring 94.

Next, referring to FIG. 16, the locking lever 15 is in the position in which it does not contact the sliding cover 90, that is, in its unlocking position, because the second protrusion 18 moved the locking lever 15 in the opposite direction from the direction W which is roughly perpendicular to the closing directing Q of the external cover 12, by pressing on the parallel surface 15*b* of the locking lever 15. Further, the locking lever 15 is kept in contact with the second protrusion 18 by being kept pressured in the direction W, that is, toward the external cover 12.

Thus, as the external cover 12 is opened when the above-mentioned components of the apparatus main assembly 10 and the fixing device 70 are in the state shown in FIGS. 12 and 16, the wall 42*a* moves with the external cover 12 in the direction R in which the external cover 12 is to be opened. Thus, the first and second protrusions 17 and 18 move in the direction R in which the external cover 12 is opened. This movement of the protrusions 17 and 18 allows the sliding cover 90, which is in contact with the first protrusion 17, to be moved in the direction (the same as opening direction R) to close the recording medium passage, by the resiliency of the spring 94.

The locking lever 15 is under the pressure generated by the locking spring 16 in the direction to move the locking lever 15 in the direction W, and the parallel surface 15*b* and second protrusion 18 are in contact with each other. Therefore, as long as the second protrusion 18 remains in contact with the parallel surface 15*b*, the locking lever 15 does not begin to move. The parallel surface 15*b* is given a preset length to create such a time lag that the sliding cover 90 begins to move before the locking lever 15 begins to move.

As the external cover 12 is opened further, that is, moved in the direction R, the first protrusion 17 is moved in the direction R (external cover opening direction), and the sliding cover 90 is moved in the direction R by the resiliency of the spring 94. Consequently, the end surface 92*a* of the support section 92 of the sliding cover 90 comes into contact with the entrance guide 80, that is, the sliding cover 90 is moved into its closed position in which it provides the recording medium passage with the gap V. With the provision of the gap V, the sheet S remaining pinched between the fixation roller 71 and the pressure roller 72 can be easily extracted. Therefore, it is possible to prevent the problem that when a jammed sheet S is removed, the sheet S tears and/or the sliding cover 90 is soiled by the unfixed toner on the sheet S.

As the external cover 12 is opened further when it is in the state shown in FIG. 17, the first protrusion 17 separates from the sliding cover 90, and also, the point of contact between the second protrusion 18 and the locking lever 15 begins to move from the parallel surface 15*b* to the slanted surface 15*c*. Then, as the second protrusion 18 comes into contact with the slanted surface 15*c*, the locking lever 15 begins to be pivotally moved toward the sliding cover 90 by the resiliency of the locking spring 16, because the slanted surface 15*c* is slanted toward the pivot 15*a* of the locking lever 15. Since the parallel surface 15*b* is given the preset length, there is provided such a time lag that the locking lever 15 begins to move after the sliding cover 90 stops moving.

Referring to FIG. 18, as the external cover 12 is opened further when the fixing device 70 is in the above described state, the locking surface 15*d* of the locking lever 15 begins to engage with the locking surface 92*b* of the sliding cover 90, and moves into the position in which it locks the sliding cover 90. Then, the locking lever 15 is kept in this position by the resiliency of the locking spring 16. At this point, the locking surface 15*d* of the locking lever 15 and the locking surface 92*b* of the sliding cover 90 form the accurate angle θ, relative to the straight line T which is perpendicular to the line which coincides with the outward edge of the locking surface 92*b* of the sliding cover 90 and the pivot 15*a* of the locking lever 15. Further, the two surfaces 92*b* and 15*d* are on the closing side of the line T. Therefore, even if force happens to be applied to the sliding cover 90 in the direction (indicated by arrow mark Q) to open the sliding cover 90 by a finger, or the like, of an operator, the force does not generate moment in the direction to disengage the locking lever 15, an therefore, the sliding cover 90 is prevented from being opened.

As the fixing device 70 is removed from the apparatus main assembly 10 when it is in the state shown in FIG. 18, its state changes into the one shown in FIG. 13. The direction in which the locking lever 15 keeps the sliding cover 90 locked is opposite from the direction (indicated by arrow mark R) in which the fixing device 70 is extracted from the apparatus main assembly 10. Therefore, it does not occur that the locking lever 15 prevents the fixing device 70 from being extracted.

Further, it is the apparatus main assembly 10 that is provided with the locking lever 15. Therefore, after the extraction of the fixing device 70 from the apparatus main assembly 10, the sliding cover 90 can be opened by a finger or the like. Therefore, even if pieces of jammed sheet S are remaining in the fixing device 70, they can be easily removed. Normally, the interior of the fixing device 70 remains protected by the sliding cover 90.

Further, the locking lever 15 is positioned so that when the fixing device 70 is installed into the apparatus main assembly 10, it will be on the upstream side of the fixing device 70 in terms of the direction in which the fixing device 70 is to be inserted into the apparatus main assembly 10. Therefore, the locking lever 15 does not interfere with the insertion of the fixing device 70 into the apparatus main assembly 10. Further, until the fixing device 70 is inserted all the way into the apparatus main assembly 10, the locking lever 15 remains in the locking position. Therefore, it is after the completion of the installation of the fixing device 70 into the apparatus main assembly 10 that the sliding cover 90 remains locked by the locking lever 15.

The movements of the above described components of the fixing device 70 and apparatus main assembly 10, which occur when the external cover 12 is closed, are opposite in direction from those which occur when the external cover 12 is opened. That is, as the external cover 12 is opened, the second protrusion 18 moves from the slanted surface 15*c* of the locking lever 15 to the parallel surface 15*b* of the locking lever 15, causing, thereby, the locking lever 15 to move from the locking position to the unlocking position. Thus, the sliding cover 90 becomes slidable, and therefore, is moved from the closed position to the open position by the spring 94. As the external cover 12 is completely closed, the image forming apparatus 1 is ready for image formation.

In the case of the image forming apparatus 1 in this embodiment, as the external cover 12 is closed, not only does the movement of the external cover 12 cause the sliding cover 90 to cover the upstream side of the fixation roller 71 and the pressure roller 72, but also, causes the locking lever 15 to lock the sliding cover 90 in position. Therefore, it is impossible for a user to open the sliding cover 90 with his or her finger or the like when the external cover 12 is open. Therefore, it is possible to prevent the problem that the finger, or the like, of a user comes into contact with the fixation roller 71 and pressure roller 72 from the upstream side of the fixing device 70. Therefore, it is possible to prevent the problem that the fixation roller 71 and the pressure roller 72 are accidentally damaged and/or soiled by the finger, or the like, of a user.

Also in the case of the image forming apparatus 1 in this embodiment, as the external cover 12 is closed, not only does the movement of the external cover 12 cause the locking lever 15 to unlock the sliding cover 90, but also, allow the sliding cover 90 to be moved to expose the upstream side of the fixation roller 71 and the pressure roller 72. Therefore, it does not occur that the sliding cover 90 interferes with the conveyance of the sheet S while the external cover 12 remains closed, that is, while the image forming apparatus is in operation.

This embodiment was described with reference to the fixing device 70 which employs a pair of compression rollers. However, this embodiment is not intended to limit the present invention in scope in terms of type of fixation roller and/or pressure roller. For example, the present invention is also applicable to a fixing device which employs a fixation belt unit, instead of the pressure roller 72 and/or fixation roller 71.

Further, this embodiment was described with reference to a case where the sliding cover 90 was on the upstream side of the combination of the fixation roller 71 and the pressure roller 72. However, this embodiment is not intended to limit the present invention in scope in terms of the positioning of the sliding cover. For example, the present invention is also applicable to a fixing device, the sliding cover 90 of which is on the downstream side of the combination of the fixation roller 71 and the pressure roller 72.

Also in this embodiment, it was the apparatus main assembly 10 that was provided with the locking lever 15 and locking spring 16. However, this embodiment is not intended to limit the present invention in scope in terms of where the locking lever 15 and locking spring 16 are attached. For example, the present invention is also applicable to a case where it is the fixing device 70 that is provided with the locking lever 15 and locking spring 16. In this case, even after the removal of the fixing device 70 from the apparatus main assembly 10, the sliding cover 90 remains locked by the locking lever 15. Therefore, it is possible to prevent the problem that the sliding cover 90 is accidentally opened by a finger, or the like, of a user when the fixing device 70 is out of the apparatus main assembly 10.

Further, the present invention is also applicable to a case in which the fixing device 70 is provided with the sliding cover 90 and the locking lever 15, and the apparatus main assembly 10 is provided with the spring 94 and the locking spring 16. In this case, it is desired that the fixing device 70 is provided with a holding means for keeping the locking lever 15 in the locking position even after the removal of the fixing device 70 from the apparatus main assembly 10. As for this locking lever holding means, a mechanism that makes the locking lever 15 and the sliding cover 90 elastically deform to make them engage with each other, a mechanism that employs magnets to make the locking lever 15 and sliding cover 90 engage with each other, or the like, may be used.

Further, this embodiment was described with reference to a case in which the fixing device 70 is in the form of a unit, the cover opening/closing device of which is removably installable in the apparatus main assembly 10. However, this embodiment is not intended to limit the present invention in scope in terms of the cover opening/closing device. For example, the present invention is also applicable to a combination of an image forming apparatus and a fixing device, the cover opening/closing device of which is used to open or close the component fixed to the apparatus main assembly 10.

Further, this embodiment was described with reference a case in which the cover of the unit removably installable in the apparatus main assembly 10 is opened or closed. However, this embodiment is not intended to limit the present in scope in terms of which cover of the image forming apparatus (fixing device) is opened or closed. For example, the present invention is also applicable to a case in which the cover of a unit removably installable in the external cover 12 is opened or closed. In this case, the first and second protrusion 17 and 18 are to be parts of the apparatus main assembly 10.

Further, this embodiment was described with reference to a case in which the fixing device 70 is a unit of the cover opening/closing unit 2. However, this embodiment is not intended to limit the present invention in scope. For example, the present invention is also applicable to a shutter mechanism for the photosensitive drums 32*y*, 32*m*, 32*c*, and 32*k* of the image forming portion 31, a conveying apparatus having a pair of rotationally drivable rollers, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 179806/2013 and 196966/2013 filed Aug. 30, 2013 and Sep. 24, 2013, respectively, which are hereby incorporated by reference.

What is claimed is:

1. An image forming apparatus comprising:

(i) an image forming station configured to form an image on a recording material;

(ii) a mounting portion;

(iii) an image heating unit detachably mountable to said mounting portion, said image heating unit including, (iii-i) a pair of rotatable members configured to nip and feed the recording material in heating an image formed on the recording material by said image forming station;

(iii-ii) a casing enclosing said rotatable members and provided with an opening configured to permit passage of the recording material;

(iii-iii) a movable member movable relative to said opening between a first position taken when the image heating process is carried out and a second position in which a jam clearance operation is operable through said opening and in which a test finger stipulated in JIS C 0922 probe cord B is prevented from entering through said opening into said casing;

(iii-iv) a locking mechanism including a locking portion configured to lock said movable member in the second position and an urging portion configured to urge said locking portion;

(iv) an interrelating mechanism configured to interrelate a locking operation of said locking member with an operation of dismounting said image heating unit from said mounting portion and to interrelate an unlocking operation of said locking mechanism with an operation of mounting said image heating unit to said mounting portion;

(v) a door configured to open and close when said image heating unit is dismounted from said mounting portion; and (vi) a movable portion configured to move said locking portion to an unlocking position against an urging force of said urging portion.

2. An apparatus according to claim 1, wherein said image heating unit further includes an urging member configured to urge said movable member in a direction from the first position toward the second position.

3. An apparatus according to claim 1, wherein said movable portion permits movement of said locking portion to the locking position by an urging force of said urging portion.

4. An apparatus according to claim 3, wherein said movable portion contacts to movable member with a closing operation of said door, and is spaced from movable member with an opening operation of said door.

5. An image forming apparatus comprising:

(i) an image forming station configured to form an image on a recording material;

(ii) a mounting portion;

(iii) an image heating unit detachably mountable to said mounting portion, said image heating unit including, (iii-i) a pair of rotatable members configured to nip and feed the recording material in heating an image formed on the recording material by said image forming station;

(iv-ii) a casing enclosing said first and second rotatable member and provided with an opening configured to permit passage of the recording material;

(iii-iii) a movable member movable relative to said opening between a first position taken when the image heating process is carried out and a second position in which a jam clearance operation is operable through said opening and in which the width of the opening measured in a direction substantially perpendicular to a longitudinal direction of said casing is less than 12 mm; and (iii-iv) a locking mechanism including a locking portion configured to lock said movable member in the second position, and an urging portion configured to urge said locking portion;

(iv) an interrelating mechanism configured to interrelate a locking operation of said locking member with an operation of dismounting said image heating unit from said mounting portion and to interrelate an unlocking operation of said locking mechanism with an operation of mounting said image heating unit to said mounting portion;

(v) a door configured to open and close when said image heating unit is dismounted from said mounting portion; and (vi) a movable portion configured to move said locking portion to an unlocking position against an urging force of said urging portion.

6. An apparatus according to claim 5, wherein said image heating unit further includes an urging member configured to urge said movable member in a direction from the first position toward the second position.

7. An apparatus according to claim 5, wherein said movable portion permits movement of said locking portion to the locking position by an urging force of said urging portion.

8. An apparatus according to claim 7, wherein said movable portion contacts to movable member with a closing operation of said door, and is spaced from said movable member with an opening operation.

9. An image forming apparatus comprising:

(i) an image forming station configured to form an image on a recording material;

(ii) a mounting portion;

(iii) an image heating unit detachably mountable to said mounting portion, said image heating unit including, (iii-i) a pair of rotatable members configured to nip and feed the recording material in heating an image formed on the recording material by said image forming station;

(iii-ii) a casing enclosing said rotatable members and provided with an opening configured to permit passage of the recording material;

(iii-iii) a shutter configured to open and close said opening; and (iii-iv) an urging member configured to urge said shutter from an opening position toward a closing position;

(iv) a locking member configured to lock said shutter in a closing position;

(v) a door configured to open and close when said image heating unit is dismounted;

(vi) an interrelating mechanism configured to interrelate a locking operation of said locking member with a closing operation of said door and configured to interrelate an unlocking operation of said locking member with an opening operation of said door, wherein said interrelating mechanism includes a movable portion configured to move said shutter from the closing position to the opening position against an urging force of said urging member.

10. An apparatus according to claim 9, wherein said movable portion permits movement of said shutter from the opening position to the closing position by an urging force of said urging member, in accordance with the opening operation of said door.

11. An apparatus according to claim 10, wherein said movable portion contacts said shutter with a closing operation of said door, and is spaced from said shutter with an opening operation.

* * * * *